US007762643B2

(12) United States Patent
Sakai

(10) Patent No.: US 7,762,643 B2
(45) Date of Patent: Jul. 27, 2010

(54) IMAGE FORMING APPARATUS, IMAGE FORMING PROGRAM, IMAGE FORMING METHOD, DATA GENERATING APPARATUS, DATA GENERATING PROGRAM, DATA GENERATING METHOD, AND RECORDING MEDIUM WITH THE PROGRAM RECORDED THEREIN

(75) Inventor: Hiroaki Sakai, Chino (JP)

(73) Assignee: Seiko Epson Corporation (JP)

( * ) Notice: Subject to any disclaimer, the term of this patent is extended or adjusted under 35 U.S.C. 154(b) by 614 days.

(21) Appl. No.: 11/570,486

(22) PCT Filed: Sep. 29, 2005

(86) PCT No.: PCT/JP2005/018507

§ 371 (c)(1),
(2), (4) Date: Dec. 12, 2006

(87) PCT Pub. No.: WO2006/036023

PCT Pub. Date: Apr. 6, 2006

(65) Prior Publication Data

US 2007/0247491 A1 Oct. 25, 2007

(30) Foreign Application Priority Data

Sep. 30, 2004 (JP) ..... 2004-288678

(51) Int. Cl.
*B41J 29/393* (2006.01)

(52) U.S. Cl. ..... 347/19; 347/15

(58) Field of Classification Search ..... 347/15, 347/43, 19, 12; 358/1.2, 1.9
See application file for complete search history.

(56) References Cited

U.S. PATENT DOCUMENTS

| | | | | |
|---|---|---|---|---|
| 5,581,284 | A * | 12/1996 | Hermanson | 347/43 |
| 6,283,571 | B1 | 9/2001 | Zhou | |
| 6,293,643 | B1 | 9/2001 | Shimada | |
| 6,328,404 | B1 | 12/2001 | Fujimori | |
| 6,733,100 | B1 | 5/2004 | Fujita et al. | |
| 7,438,375 | B2 * | 10/2008 | Arazaki | 347/15 |

FOREIGN PATENT DOCUMENTS

| | | |
|---|---|---|
| JP | 01-235655 | 9/1989 |
| JP | 11-151821 | 6/1999 |
| JP | 11-254662 | 9/1999 |
| JP | 2000-79710 | 3/2000 |
| JP | 2000-190470 | 7/2000 |
| JP | 2000-225716 | 8/2000 |
| JP | 2001-63008 | 3/2001 |
| JP | 2002-331694 | 11/2002 |
| JP | 2003-063043 | 3/2003 |

* cited by examiner

OTHER PUBLICATIONS

International Search Report and Written Opinion of the ISA for PCT/JP2005/018507; dated Oct. 24, 2005; ISA/JP.

*Primary Examiner*—Lamson D Nguyen
(74) *Attorney, Agent, or Firm*—Harness, Dickey & Pierce, P.L.C.

(57) ABSTRACT

In an image forming method employing an inkjet technique, when a dot is formed by the use of a normal nozzle and an abnormal nozzle neighboring to the abnormal nozzle, binary data are corrected so as not to form the dot by the use of the abnormal nozzle and the binary data are also corrected so as to form a compensation dot, which has a color different from a color used by the abnormal nozzle, in the vicinity of a dot forming position by the abnormal nozzle. Thereby, the white stripe and the deep-colored stripe generated due to the flight bending phenomenon are almost invisible.

6 Claims, 13 Drawing Sheets

IMAGE FORMING APPARATUS, IMAGE FORMING PROGRAM, IMAGE FORMING METHOD, DATA GENERATING APPARATUS, DATA GENERATING PROGRAM, DATA GENERATING METHOD, AND RECORDING MEDIUM WITH THE PROGRAM RECORDED THEREIN

TECHNICAL FIELD

The present invention relates to an image forming apparatus such as a facsimile apparatus, a copying machine, and a printer of OA equipment, an image forming program, an image forming method, a data generating apparatus, a data generating program, a data generating method, and a recording medium with the program recorded therein. More particularly, the present invention relates to an image forming apparatus which can be suitably applied to a so-called inkjet printer, which forms predetermined letters or images by landing particles of liquid ink with a plurality of colors on a print sheet, an image forming program, an image forming method, a data generating apparatus, a data generating program, a data generating method, and a recording medium with the program recorded therein.

TECHNICAL BACKGROUND

Now, a printing apparatus, which is an example of an image forming apparatus, particularly, an inkjet type printing apparatus (printer) will be exemplified.

Since printers employing ah inkjet technique (hereinafter, referred to as "inkjet printers") are generally low in price and can easily provide color printed matters with high quality, the inkjet printers are widely spread to personal users as well as offices, with spread of personal computers, digital cameras, and the like.

Such inkjet printers draw predetermined letters or images on a print sheet by jetting particles of liquid ink in the shape of dots from nozzles of a print head while reciprocating a mobile body, which is generally referred to as a "carriage" integrally provided with an ink cartridge and a print head, in a direction (the width direction of the print sheet) perpendicular to the sheet transfer direction, thereby making a printed matter. By providing the carriage with four color ink cartridges (yellow, magenta, cyan, and black) including black and four-color print head, it is possible to easily carry out full-color printing in which the colors are combined, as well as monochromic printing (six colors, seven colors, or eight colors obtained by adding light cyan, light magenta, or the like to the four colors are practical).

In this way, in the technique that performs the printing while reciprocating the carriage in the direction perpendicular to the sheet transfer direction, since it is necessary to reciprocate the carriage several tens to hundred times for printing a whole page, there is a disadvantage that much printing time is required compared with a laser printer employing another technique such as an electrophotography technique as used in copiers. The inkjet printers employing such a technique are referred to as "multi-pass type printers" or "serial printers".

On the contrary, in inkjet printers referred to as "line-head type printers" in which a long print head having a length equal to the width of the print sheet is disposed in the direction perpendicular to the sheet transfer direction and the carriage is not used, it is not necessary to move the print head in the width direction and the printing can be carried out by a single scan (single pass), thereby carrying out the printing at a speed higher than that of the above-mentioned technique. In addition, since the carriage for mounting the print head or a driving system for moving the carriage is not necessary, there is an advantage that a printer case can decrease in size and weight and its quietness is improved. The inkjet printer employing such a technique is referred to as a "line-head type printer".

Since the print head essential for the inkjet printer has a structure that micro nozzles having a diameter of 10 to 70 μm are arranged in series or in multi lines in the printing direction with a constant pitch, a part of the micro nozzles may be clogged due to production errors or introduction of dust during manufacturing it.

As a result, the jetting of ink is not possible and thus the dots may not be formed at a predetermined position. In addition, since the amount of jetted ink may be smaller than a predetermined amount, printing failure referred to as a "white stripe" (when the print sheet is white) or a "nozzle omission" may occur in a portion corresponding to the defective nozzle. Specifically, such as white stripe phenomenon can be generated more remarkably in the "line-head type printer" in which the print head is fixed and the number of nozzles is remarkably great than in the above-mentioned "multi-pass type printer (serial printer)".

As a result, in order to prevent the generation of such a white stripe, research and development in hardware such as improvement in the technique for manufacturing a print head and improvement in design have gone on. However, it is difficult to provide a print head not generating the white stripe at all in view of production cost, print quality, and techniques.

Therefore, in addition to improvement in hardware described above, a technique that the white stripe is invisible to the naked eye by the use of a software technique such as printing control described later is used together currently.

For example, in Japanese Unexamined Patent Application Publication No. 2003-63043, there is disclosed a technique that when a so-called nozzle omission occurs in a "black dot", the white stripe is corrected by controlling a color print head so as to jet a different color of ink to the portion corresponding to the nozzle omission and to synthesize the "black dot" or that when the nozzle omission occurs in a "color dot" other than black, the white stripe is corrected by controlling the print head so as to increase the size of color dots having the same color as the surroundings of the portion corresponding to the nozzle omission.

In Japanese Unexamined Patent Application Publication No. 2002-331694, there is disclosed a technique that the white stripe is invisible to the naked eye by jetting a different color of ink, which is close to the color of the dots, to the portion corresponding to the white stripe, or by deviating the different color of dots from the original position by half pitch.

The white stripe phenomenon described above can result from a reason that a part of nozzles are formed in positions deviated from predetermined positions due to production errors of the print head or a reason (flight bending phenomenon) that the jetting direction of ink is not vertical to the print sheet but oblique thereto, thereby forming the dots in positions deviated from target positions, in addition to the jetting failure of ink due to the nozzle clogging.

There is a problem that the white stripe generated due to the deviation in position of the nozzles or the flight bending phenomenon is more visible to the naked eye than the white stripe generated due to the nozzle clogging.

That is, in the white stripe generated due to the deviation in position of the nozzles or the flight bending phenomenon can be more emphasized, since the ink that should be jetted to the white stripe portion is jetted to come close to dots at normal positions or to overlap a part thereof with the dots, the color concentration of the portion can increase and the deep-colored stripe can be simultaneously generated in the vicinity of the white stripe. Accordingly, the white stripe can be further emphasized.

On the other hand, it can be considered as in the related art that the dots formed by the use of nozzles generating the flight bending phenomenon or nozzles adjacent thereto should be enlarged so as to fill the white stripe portion. However, in this case, the area in which the enlarged dots are overlapped with other dots increases and thus the deep-colored stripe can be visible to the naked eye.

Therefore, the present invention is contrived to solve the above-mentioned problems. It is an object of the present invention to provide a novel image forming apparatus which can remove or make the white stripe or the deep-colored stripe generated due to the flight bending phenomenon or the deviation in position of nozzles invisible to the naked eye, an image forming program, an image forming method, a data generating apparatus, a data generating program, a data generating method, and a recording medium in which the program is recorded.

DISCLOSURE OF THE INVENTION

[Aspect 1] According to Aspect 1 of the present invention, there is provided an image forming apparatus that forms a predetermined image with N-valued (N≧2) data on a print medium by jetting an ink from a plurality of nozzle modules, which are arranged in a print head by colors, while moving one or both of the print medium and the print head, the image forming apparatus comprising: an N-valued data acquiring means for acquiring the N-valued (N≧2) data; a print-head characteristic grasping means for grasping a characteristic of the print head; a data correcting means for correcting the N-valued (N≧2) data based on the characteristic of the print head grasped by the print-head characteristic grasping means; and a printing means for performing the printing based on the corrected data output from the data correcting means, wherein when a dot is formed by the use of a normal nozzle and an abnormal nozzle detected by the print-head characteristic grasping means, the data correcting means corrects the N-valued (N≧2) data so as not to form a dot by the use of the abnormal nozzle and corrects the N-valued (N≧2) data so as to form a compensation dot, which has a color different from a color used by the abnormal nozzle, in the vicinity of a dot forming position by the abnormal nozzle.

Accordingly, since the dots having a different color are formed in a stripe portion (for example, a white stripe portion when the print medium is white) generated due to a flight bending phenomenon or the clogging of a nozzle, visibility of the white stripe deteriorates and it is thus possible to remove the white stripe or to make the white stripe invisible to the naked eye.

When an ink is jetted from the abnormal nozzle detected by the print-head characteristic grasping means and the normal nozzle adjacent to the abnormal nozzle, the dots are not formed by the use of the abnormal nozzle, for example, by stopping the jetting of the ink from the abnormal nozzle. Accordingly, since the dots are not formed to overlap the dots at the normal position adjacent thereto, a deep-colored stripe generated at the overlapping portion can be simultaneously removed.

As a result, it is possible to obtain a printed matter with high quality in which the white stripe or the deep-colored stripe is almost invisible to the naked eye, even by the use of the print head generating the flight bending phenomenon or the deviation in position of the nozzles. In addition, the conventional inkjet printer can be used as the printing means without any change.

The "dot" mentioned in this aspect is a basic unit for marking letters shapes of a printed matter and means an area that an ink jetted from one or plural nozzles is landed on the print medium. The "dot" is not "zero" but has a predetermined size (area). Of course, dots having various sizes exist. The shape of the dot is not limited to a circular shape, but may include shapes other than the circular shape such as an elliptical shape. In this case, since its diameter is not constant, the size of the dot is determined based on the area of the dot or the average diameter of the dot (The same is applicable to Aspects relating to an "image forming apparatus", Aspects, relating to an "image forming program", Aspects relating to, an "image forming method", Aspects relating to a "data generating apparatus", and BEST MODE FOR CARRYING OUT THE INVENTION).

More accurately defining the "dot diameter", an equivalent circular dot having an area equal to the area of a dot formed by jetting a predetermined amount of ink is supposed and the diameter of the equivalent circular dot is set as the dot diameter. Generally, the absorption rate of ink varies depending upon print media. Accordingly, when the print medium is changed, the dot diameter varies variously even with a constant amount of ink, of course. The "dot" is not limited to a dot formed by one ink droplet jetted from one nozzle, but may include a dot formed by combining the ink droplets jetted from two or more nozzles such as an extremely large dot.

The "flight bending phenomenon" means a phenomenon that some nozzles jet an ink but the jet trajectory of the nozzles is bent, thereby forming dots at positions deviated from target landing positions, unlike a phenomenon that some nozzles do not jet an ink (The same is applicable to Aspects relating to an "image forming apparatus", Aspects relating to an "image forming program", Aspects relating to an "image forming method", Aspects relating to a "data generating apparatus", and BEST MODE FOR CARRYING OUT THE INVENTION).

The "white stripe" means a portion (area) in which a phenomenon that the distance between adjacent dots becomes greater than a predetermined distance due to the "flight bending phenomenon" continuously occurs and thus the color of the print medium is visible to the naked eye in a stripe shape. The "deep-colored stripe" means a portion (area) in which a phenomenon that the distance between adjacent dots becomes smaller than a predetermined distance due to the "flight ending phenomenon" continuously occurs and thus the color of the print medium is invisible or a part of the deviated dots overlap with normal dots, thereby making the overlapping portion visible to the naked eye in a deep-colored stripe shape (The same is applicable to Aspects relating to an "image forming apparatus", Aspects relating to an "image forming program", Aspects relating to an "image forming method", Aspects relating to a "data generating apparatus", and BEST MODE FOR CARRYING OUT THE INVENTION).

The "N-valued (N≧2) data" include information (binary data) on existence of dots having each color in each pixel and information on the size of the dots (The same is applicable to Aspects relating to an "image forming apparatus", Aspects relating to an "image forming program", Aspects relating to an "image forming method", Aspects relating to a "data generating apparatus", and BEST MODE FOR CARRYING OUT THE INVENTION).

The "characteristic of the print head grasped by the print-head characteristic grasping means" includes "flight bending information" indicating to what extent the respective nozzle generates the flight bending and "clogging information" indicating which nozzle cannot jet the ink.

Here, "grasping" mentioned in the present invention includes tabling the information on the characteristic of the print head such as the flight bending information and the clogging information and referring to the table.

The "data correcting means" corrects the N-valued (N≧2) data based on the characteristic of the print head grasped, by the print-head characteristic grasping means. Here, specifically "to correct the N-valued (N≧2) data based on the characteristic of the print head" includes: 1. to perform data correction to a largely deviated position (specifically, a position where the distance between two dots is greater than the dot diameter) based on the flight bending information; 2. to perform data correction such as dot omission without using the nozzle corresponding to the largely deviated position; 3. to perform a data correction with using the nozzle corresponding to the largely deviated position; and 4. to perform dot omission.

"Detection" includes a meaning of "reference" in addition to its literal meaning (The same is applicable to Aspects relating to an "image forming apparatus", Aspects relating to an "image forming program", Aspects relating to an "image forming method", Aspects relating to a "data generating apparatus", and BEST MODE FOR CARRYING OUT THE INVENTION).

[Aspect 2] According to Aspect 2 of the present invention, there is provided an image forming apparatus that forms a predetermined image with N-valued (N≧2) data on a print medium by jetting, an ink from a plurality of nozzle modules, which are arranged in a print head by colors, while moving one or both of the print medium and the print head, the image forming apparatus comprising: a N-valued (N≧2) data acquiring means for acquiring the N-valued (N≧2) data; a print-head characteristic grasping means for grasping a characteristic of the print head; a data correcting means for correcting the N-valued (N≧2) data-based on the characteristic of the print head grasped by the print-head characteristic grasping means; and a printing means for performing the printing based on the corrected data output from the data correcting means, wherein when a dot is formed by the use of an abnormal nozzle detected by the print head characteristic grasping means, the data correcting means corrects the N-valued (N≧22) data so as to superpositionally form a compensation dot having a different color by the use of a normal nozzle in a nozzle module for the different color.

Accordingly, similar to Aspect 1, since the dots having a different color are formed in the white stripe portion generated due to a flight bending phenomenon or the clogging of a nozzle in the vicinity of the abnormal dot, the visibility of the white stripe deteriorates and it is thus possible to remove the white stripe or to make the white stripe invisible to the naked eye.

[Aspect 3] According to Aspect 3 of the present invention, there is provided the image forming apparatus according to Aspect 1 or 2, further comprising a multi-dot forming means for controlling the print head so as to form the compensation dot greater than the dot formed by the use of a nozzle module including the abnormal nozzle.

In this way, by forming the compensation dot greater than the normal dots by the use of the multi-dot forming means, it is possible to form the compensation dot to surely cover the white stripe portion, even when the compensation dot is deviated from the target position but not abnormal, or when the width of the white stripe is great. As a result, similar to the above-mentioned aspect the visibility of the white stripe portion deteriorates, thereby making the white stripe invisible to the naked eye.

[Aspect 4] According to Aspect 4 of the present invention, there is provided the image forming apparatus according to any one of Aspects 1 to 3, wherein the data correcting means corrects the N-valued (N(2) data so as to form the compensation dot earlier than dots formed by the use of the nozzle module including the abnormal nozzle.

Accordingly, by earlier forming the compensation dot, the visibility of the white stripe portion can deteriorate, thereby making the white stripe invisible to the naked eye. In addition, since the color of the compensation dot is not viewed well, it is possible to satisfactorily avoid the generation of an unnatural color in the white stripe portion.

[Aspect 5] According to Aspect 5 of the present invention, there is provided the image forming apparatus according to any one of Aspects 1 to 4, wherein the data correcting means corrects the N-valued (N(2) data so as to form, as the compensation dot, a dot having a color of which the concentration value or the brightness value approaches the concentration value or the brightness value of the dot formed by the use of the abnormal nozzle by a predetermined value or less.

Accordingly, by using the dot having a color close to the color of the abnormal nozzle as the compensation dot, the visibility of the white stripe can deteriorate, thereby making the white stripe invisible to the naked eye. In addition, since the color of the compensation dot is not viewed well, it is possible to further deteriorate the visibility of the color stripe resulting from the correction.

[Aspect 6] According to Aspect 6 of the present invention, there is provided the image forming apparatus according to any one of Aspects 1 to 4, wherein the data correcting means corrects the N-valued (N(2) data such that when the print head can form a plurality of colors of dots and the color of the dot formed by the use of the abnormal nozzle is black, the compensation dot is formed by combining the plurality of colors.

That is, in the present aspect, when the color of the dot formed by the use of the abnormal nozzle is black, the compensation dot has a combination of different colors without singly selecting a color having a great difference in concentration with respect to black, for example, yellow. Accordingly, since the color having a great difference in concentration with respect to black is not singly selected for the compensation dot, it is possible to satisfactorily deteriorate the visibility of the white stripe.

Here, "combination" includes forming dots of a plurality of colors (The same is applicable to Aspects relating to an "image forming apparatus", Aspects relating to an "image forming program", Aspects relating to an "image forming method", Aspects relating to a "data generating apparatus", and BEST MODE FOR CARRYING OUT THE INVENTION).

[Aspect 7] According to Aspect 7 of the present invention, there is provided the image forming apparatus according to any one of Aspects 1 to 4, wherein the data correcting means corrects the N-valued (N≧2) data such that when the print head can form dots having four or more colors including black, magenta, cyan, and yellow and the color of the dot formed by the use of the abnormal nozzle is black, a dot having a combination of magenta, cyan, and yellow, a combination of magenta and cyan, a combination of magenta and yellow, a combination of cyan and yellow, or any one of magenta and cyan is formed as the compensation dot.

That is, in the present aspect, when the print head can form dots having four or more colors including black, magenta, cyan, and yellow and the color of the dot formed by the use of the abnormal nozzle is black, the compensation dot employs a color other than yellow or a combination of yellow and a different color so as not to singly select yellow having the largest difference in concentration with respect to black. Accordingly, since the color having a great difference in concentration with respect to black is not singly selected for the compensation dot, it is possible to satisfactorily deteriorate the visibility of the white stripe.

[Aspect 8] According to Aspect 8 of the present invention, there is provided the image forming apparatus according to any one of Aspects 1 to 4, wherein the data correcting means corrects the N-valued (N≧2) data such that when the print head can form dots having four or more colors including black, magenta, cyan, and yellow and the color of the dot formed by the use of the abnormal nozzle is magenta, a dot having a black color, a cyan color, or a combination of cyan and yellow is formed as the compensation dot.

That is, in the present aspect, when the print head can form dots having four or more colors including black, magenta, cyan, and yellow and the color of the dot formed by the use of the abnormal nozzle is magenta, the compensation dot employs a color other than yellow or a combination of yellow and a different color so as not to singly select yellow having the largest difference in concentration with respect to magenta. Accordingly, similar to Aspect 6, since the color having a great difference in concentration with respect to magenta is not singly selected for the compensation dot, it is possible to satisfactorily deteriorate the visibility of the white stripe.

[Aspect 9] According to Aspect 9 of the present invention, there is provided the image forming apparatus according to any one of Aspects 1 to 4, wherein the data correcting means corrects the N-valued (N≧2) data such that when the print head can form dots having four or more colors including black, magenta, cyan, and yellow and the color of the dot formed by the use of the abnormal nozzle is cyan, dots having a black color, a magenta color, or a combination of magenta and yellow is formed as the compensation dot.

That is, in the present aspect, when the print head can form dots having four or more colors including black, magenta, cyan, and yellow and the color of the dot formed by the use of the abnormal nozzle is cyan, the compensation dot employs a color other than yellow or a combination of yellow and a different color so as not to singly select yellow having the largest difference in concentration with respect to cyan. Accordingly, similar to Aspects 6, and 7, since yellow having a great difference in concentration with respect to cyan is not singly selected for the compensation dot, it is possible to satisfactorily deteriorate the visibility of the white stripe.

[Aspect 10] According to Aspect 10 of the present invention, there is provided the image forming apparatus according to Aspect 7, wherein the data correcting means corrects the N-valued (N≧2) data such that when the dot formed by the abnormal nozzle is continuous in the printing direction, two or more of a dot having a combination of magenta, cyan, and yellow, a dot having a combination of magenta and cyan, and a dot having one of magenta and cyan are alternately formed as the compensation dot.

That is, when the compensation dot is continuously formed in the printing direction, the compensation dots having colors other than yellow are alternately formed such that like color is not continuous. Accordingly, in addition to the white stripe, it is possible to avoid the generation of another colored stripe instead of the white stripe, thereby preventing another colored stripe from being visible.

[Aspect 11] According to Aspect 11 of the present invention, there is provided the image forming apparatus according to any one of Aspects 1 to 10, wherein the print-head characteristic grasping means includes a print-head characteristic storing unit in which nozzle characteristics of the print head are stored in advance, and wherein the print-head characteristic grasping means detects the abnormal nozzle every nozzle module of the print head based on the characteristics of the print head stored in the print-head characteristic storing unit.

As described above, when the compensation dot of a different color is formed in the white stripe portion by the used of the print head, it is necessary to detect the abnormal nozzle every nozzle module of the print head, that is, to accurately grasp which nozzle of which nozzle module is the abnormal nozzle generating the flight bending phenomenon.

Accordingly, in the present aspect, the print-head characteristic grasping means is provided with the print-head characteristic storing unit for storing the nozzle characteristics of the print head and the abnormal nozzle every nozzle module of the print head is properly grasped based on the characteristic of the print head stored in the print-head characteristic storing unit.

As a result, since the abnormal nozzle of the print head can be accurately grasped, it is possible to optimally form the compensation dot every print head, similar to the above-mentioned aspects.

In addition, since the portion of the abnormal dots or the number of the abnormal dots are different every print head, it is possible to rapidly cope with the case that the print head is used at the first time or the case that the print head is replaced, by storing (updating) the nozzle characteristics of the print head in the print-head characteristic storing unit when the print head is newly fitted (at the time of production) or when the print head is replaced.

[Aspect 12] According to Aspect 12 of the present invention, there is provided the image forming apparatus according to any one of Aspects 1 to 10, wherein the print-head characteristic grasping means includes a print-head characteristic detecting unit for detecting the characteristic of the print head from an image formed by the use of the print head, and wherein the print-head characteristic grasping means detects the abnormal nozzle every nozzle module of the print head based on the characteristic of the print head detected by the print-head characteristic detecting unit.

That is, although Aspect 11 copes with the difference in, characteristic of the print head by providing the print-head characteristic storing unit for storing the characteristics of the print head in advance, the present aspect includes the print-head characteristic detecting unit for detecting the characteristic of the print head from the image formed by the use of the print head, instead of the print-head characteristic storing unit.

Accordingly, similar to Aspect 11, it is possible to rapidly cope with the replacement of the print head. In addition, even when the print head varies in characteristic with use (when a new abnormal nozzle is generated), it is possible to flexibly cope with the variation in characteristic with use, by allowing the print-head characteristic detecting unit to detect the characteristic of the print head from an image formed by the use of the print head at a predetermined point of time.

[Aspect 13] According to Aspect 13 of the present invention, there is provided an image forming program for forming a predetermined image with N-valued (N≧2) data on a print medium by jetting an ink from a plurality of nozzle modules, which are arranged in a print head by colors, while moving one or both of the print medium and the print head, the image forming program allowing a computer to execute: an N-valued (N≧2) data acquiring step of acquiring the N-valued (N≧2) data; a print-head characteristic grasping step of grasping a characteristic of the print head; a data correcting step of correcting the N-valued (N≧2) data based on the characteristic of the print head grasped in the print-head characteristic grasping step; and a printing step of performing the printing based on the corrected data obtained in the data correcting step, wherein when a dot is formed by the use of a normal nozzle and an abnormal nozzle detected in the print-head characteristic grasping step, the data correcting step serves to correct the N-valued (N≧2) data so as not to form a dot by the use of the abnormal nozzle and to correct the N-valued (N≧2) data so as to form a compensation dot, which has a color different from a color used by the abnormal nozzle, in the vicinity of a dot forming position by the abnormal nozzle.

Accordingly, similar to Aspect 1, since the dots having a different color are formed in a stripe portion (for example, a white stripe portion when the print medium is white) generated due to a flight bending phenomenon or the clogging of a nozzle, the visibility of the white stripe deteriorates and it is thus possible to remove the white stripe or to make the white stripe invisible to the naked eye. In addition, when an ink is jetted from the abnormal nozzle detected in the print-head characteristic grasping step and the normal nozzle adjacent to the abnormal nozzle, the dots cannot be formed by the use of the abnormal nozzle by stopping the jetting of the ink from the abnormal nozzle. Accordingly, since the dots are not formed to overlap the dots at the normal position adjacent thereto, the concentration of the color at the overlapping portion becomes deeper and the disadvantage that the white stripe is emphasized can be avoided, thereby making the white stripe further invisible.

Since most of image forming apparatuses which currently come into the market such as inkjet printers include a computer system having a central processing unit (CPU), a storage (RAM and ROM), and an input and output unit and can embody the respective means in software by the use of the computer system, the respective steps can be economically and easily embodied in comparison with the case that the respective steps are embodied in specific hardware. A general-purpose computer system such as PC can be used for the data correcting step other than the printing step.

Furthermore, by rewriting a part of the program, the version-up due to the change or improvement in functions can be easily accomplished.

[Aspect 14] According to Aspect 14 of the present invention, there is provided an image forming program for forming a predetermined image with N-valued (N≧2) data on a print medium by jetting an ink from a plurality of nozzle modules, which are arranged in a print head by colors, while moving one or both of the print medium and the print head, the image forming program allowing a computer to execute: a N-valued data acquiring step of acquiring the N-valued (N≧2) data; a print-head characteristic grasping step of grasping a characteristic of the print head; a data correcting step of correcting the N-valued (N≧2) data based on the characteristic of the print head grasped in the print-head characteristic grasping step; and a printing step of performing the printing based on the corrected data obtained in the data correcting step, wherein when a dot is formed by the use of an abnormal nozzle detected in the print-head characteristic grasping step, the data correcting step serves to correct the N-valued (N(2) data so as to superpositionally form a compensation dot having a different color by the use of a normal nozzle in a nozzle module for the different color.

Accordingly, similar to Aspect 2, since the dots having a different color are formed in a stripe portion generated due to the flight bending phenomenon or the deviation in position of a nozzle, the visibility of the white stripe can deteriorate and thus the white stripe can be made invisible to the naked eye.

Similar to Aspect 12, since the respective means can be embodied in software by the use of PC or the computer system of the image forming apparatus, the respective means can be economically and easily embodied in comparison with the case that the respective means are embodied in specific hardware. In addition, by rewriting a part of the program, the version-up due to the change or improvement in functions can be easily accomplished.

[Aspect 15] According to Aspect 15 of the present invention, there is provided the image forming program according to Aspect 13 or 14, the image forming program allowing a computer to further execute a multi-dot forming step of controlling the print head so as to form the compensation dot greater than the dot formed by the use of a nozzle module including the abnormal nozzle.

Accordingly, similar to Aspect 3, by forming the compensation dot greater than the normal dots, it is possible to form the compensation dot to surely cover the white stripe portion, even when the compensation dot is deviated from the target position but not abnormal, or when the width of the white stripe is great. As a result, similar to the above-mentioned aspect, the visibility of the white stripe portion deteriorates, thereby making the white stripe invisible to the naked eye.

Similar to Aspect 13, since the respective means can be embodied in software by the use of PC or the computer system of the image forming apparatus, the respective means can be economically and easily embodied in comparison with the case that the respective means are embodied in specific hardware. In addition, by rewriting a part of the program, the version-up due to the change or improvement in functions can be easily accomplished.

[Aspect 16] According to Aspect 16 of the present invention, there is provided the image forming program according to any one of Aspects 13, to 15, wherein the data correcting steps serves to correct the N-valued (N≧2) data so as to form the compensation dot earlier than dots formed by the use of the nozzle module including the abnormal nozzle.

Accordingly, similar to Aspect 4, the visibility of the white stripe portion can deteriorate, thereby making the white stripe invisible to the naked eye. In addition, since the color of the compensation dot is not viewed well, it is possible to satisfactorily avoid the generation of an unnatural color in the white stripe portion.

Similar to Aspect 13, since the respective means can be embodied in software by the use of PC or the computer system of the image forming apparatus, the respective means can be economically and easily embodied in comparison with the case that the respective means are embodied in specific hardware. In addition, by rewriting a part of the program, the version-up due to the change or improvement in functions can be easily accomplished.

[Aspect 17] According to Aspect 17 of the present invention, there is provided the image forming program according to any one of Aspects 13 to 16, wherein the data correcting step serves to correct the N-valued (N≧2) data so as to form, as the compensation dot, a dot having a color of which the concentration value or the brightness value approaches the concentration value or the brightness value of the dot formed by the use of the abnormal nozzle by a predetermined value or less.

Accordingly, similar to Aspect 5, the visibility of the white stripe can deteriorate, thereby making the white stripe invisible to the naked eye. In addition, since the color of the compensation dot is not viewed well, it is possible to further deteriorate the visibility of the color stripe resulting from the correction.

Similar to Aspect 13, since the respective means can be embodied in software by the use of PC or the computer system of the image forming apparatus, the respective means can be economically and easily embodied in comparison with the case that the respective means are embodied in specific hardware. In addition, by rewriting a part of the program, the version-up due to the change or improvement in functions can be easily accomplished.

[Aspect 18] According to Aspect 18 of the present invention, there is provided the image forming program according to any one of Aspects 13 to 16, wherein the data correcting step serves to correct the N-valued (N≧2) data such that when the print head can form a plurality of colors of dots and the color of the dot formed by the use of the abnormal nozzle is black, the compensation dot is formed by combining the plurality of colors.

Accordingly, similar to Aspect 6, since the color having a great difference in concentration with respect to black is not singly selected for the compensation dot, it is possible to satisfactorily deteriorate the visibility of the white stripe.

Similar to Aspect 13, since the respective means can be embodied in software by the use of PC or the computer system of the image forming apparatus, the respective means can be economically and easily embodied in comparison with the case that the respective means are embodied in specific hardware.

In addition, by rewriting a part of the program, the version-up due to the change or improvement in functions can be easily accomplished.

[Aspect 19] According to Aspect 19 of the present invention, there is provided the image forming program according to any one of Aspects 13 to 16, wherein the data correcting step serves to correct the N-valued (N≧2) data such that when the print head can form dots having four or more colors including black, magenta, cyan, and yellow and the color of the dot formed by the use of the abnormal nozzle is black, a dot having a combination of magenta, cyan, and yellow, a combination of magenta and cyan, a combination of magenta and yellow, a combination of cyan and yellow, or any one of magenta and cyan is formed as the compensation dot.

Accordingly, similar to Aspect 7, since yellow having a greatest difference in concentration with respect to black is not singly selected for the compensation dot, it is possible to satisfactorily deteriorate the visibility of the white stripe.

Similar to Aspect 13, since the respective means can be embodied in software by the use of PC or the computer system of the image forming apparatus, the respective means can be economically and easily embodied in comparison with the case that the respective means are embodied in specific hardware. In addition, by rewriting a part of the program, the version-up due to the change or improvement in functions can be easily accomplished.

[Aspect 20] According to Aspect 20 of the present invention, there is provided the image forming program according to any one of Aspects 13 to 16, wherein the data correcting step serves to correct the N-valued (N≧2) data such that when the print head can form dots having four or more colors including black, magenta, cyan, and yellow and the color of the dot formed by the use of the abnormal nozzle is magenta, a dot having a black color, a cyan color, or a combination of cyan and yellow is formed as the compensation dot.

Accordingly, similar to Aspect 8, since the color having a great difference in concentration with respect to magenta is not singly selected for the compensation dot, it is possible to satisfactorily deteriorate the visibility of the white stripe.

Similar to Aspect 13, since the respective means can be embodied in software by the use of PC or the computer system of the image forming apparatus, the respective means can be economically and easily embodied in comparison with the case that the respective means are embodied in specific hardware. In addition, by rewriting a part of the program, the version-up due to the change or improvement in functions can be easily accomplished.

[Aspect 21] According to Aspect 21 of the present invention, there is provided the image forming program according to any one of Aspects 13 to 16, wherein the data correcting step serves to correct the N-valued (N≧2) data such that when the print head can form dots having four or more colors including black, magenta, cyan, and yellow and the color of the dot formed by the use of the abnormal nozzle is cyan, dots having a black color, a magenta color, or a combination of magenta and yellow is formed as the compensation dot.

Accordingly, similar to Aspects 9, since yellow having a great difference in concentration with respect to cyan is not singly selected for the compensation dot, it is possible to satisfactorily deteriorate the visibility of the white stripe.

Similar to Aspect 13, since the respective means can be embodied in software by the use of PC or the computer system of the image forming apparatus, the respective means can be economically and easily embodied in comparison with the case that the respective means are embodied in specific hardware. In addition, by rewriting a part of the program, the version-up due to the change or improvement in functions can be easily accomplished.

[Aspect 22] According to Aspect 22 of the present invention, there is provided the image forming program according to Aspect 20, wherein the data correcting step serves to correct the N-valued (N≧2) data such that when the dot formed by the abnormal nozzle is continuous in the printing direction, two or more of a dot having a combination of magenta, cyan, and yellow, a dot having a combination of magenta and cyan, and a dot having one of magenta and cyan are alternately formed as the compensation dot.

Accordingly, similar to Aspect 10, it is possible to avoid the generation of another colored stripe instead of the white stripe, in addition to the white stripe, thereby preventing another colored stripe from being visible.

Similar to Aspect 13, since the respective means can be embodied in software by the use of PC or the computer system of the image forming apparatus, the respective means can be economically and easily embodied in comparison with the case that the respective means are embodied in specific hardware. In addition, by rewriting a part of the program, the version-up due to the change or improvement in functions can be easily accomplished.

[Aspect 23] According to Aspect 23 of the present invention, there is provided the image forming program according to any one of Aspects 13 to 16, wherein the print-head characteristic grasping step includes a print-head characteristic storing step of storing nozzle characteristics of the print head in advance, and wherein the print-head characteristic grasping step serves to detect the abnormal nozzle every nozzle module of the print head based on the characteristics of the print head stored in the print-head characteristic storing step.

Accordingly, similar to Aspect 11, since the abnormal nozzle of the print head can be accurately grasped, it is possible to optimally form the compensation dot every print head, similar to the above-mentioned aspects.

Similar to Aspect 13, since the respective means can be embodied in software by the use of PC or the computer system of the image forming apparatus, the respective means can be economically and easily embodied in comparison with the case that the respective means are embodied in specific hardware. In addition, by rewriting a part of the program, the version-up due to the change or improvement in functions can be easily accomplished.

[Aspect 24] According to Aspect 24 of the present invention, there is provided the image forming program according to any one of Aspects 13 to 23, wherein the print-head characteristic grasping step includes a print-head characteristic detecting step of detecting the characteristic of the print head from an image formed by the use of the print head, and wherein the print-head characteristic grasping step serves to detect the abnormal nozzle every nozzle module of the print head based on the characteristic of the print head detected in the print-head characteristic detecting step.

Accordingly, similar to Aspect 11, it is possible to rapidly cope with the replacement of the print head. In addition, even when the print head varies in characteristic with use (when a new abnormal nozzle is generated), it is possible to flexibly cope with the variation in characteristic with use, by allowing the print-head characteristic detecting step to serve to detect the characteristic of the print head from an image formed by the use of the print head at a predetermined point of time.

Similar to Aspect 12, since the respective means can be embodied in software by the use of PC or the computer system of the image forming apparatus, the respective means can be economically and easily embodied in comparison with the case that the respective means are embodied in specific hardware. In addition, by rewriting a part of the program, the version-up due to the change or improvement in functions can be easily accomplished.

[Aspect 25] According to Aspect 25 of the present invention, there is provided an image forming method of forming a predetermined image with N-valued (N(2) data on a print medium by jetting an ink from a plurality of nozzle modules, which are arranged in a print head by colors, while moving one or both of the print medium and the print head, the image forming method comprising: a N-valued data acquiring step of acquiring the N-valued (N(2) data; a print-head characteristic grasping step of grasping a characteristic of the print head; a data correcting step of correcting the N-valued (N(2) data based on the characteristic of the print head grasped in the print-head characteristic grasping step; and a printing step of performing the printing based on the corrected data obtained in the data correcting step, wherein when a dot is formed by the use of a normal nozzle and an abnormal nozzle detected in the print-head characteristic grasping step, the data correcting step serves to correct the N-valued (N(2) data so as not to form a dot by the use of the abnormal nozzle and to correct the N-valued (N(2) data so as to form a compensation dot, which has a color different from a color used by the abnormal nozzle, in the vicinity of a dot forming position by the abnormal nozzle.

Substantially, the image forming method according to Aspect 25 is an image forming method of forming a predetermined image with N-valued (N(2) data on a print medium by jetting an ink from a plurality of nozzle modules, which are arranged in a print head by colors; while moving one or both of the print medium and the print head, the image forming method comprising: a N-valued data acquiring step of acquiring the N-valued (N(2) data from an input unit; a print-head characteristic grasping step of grasping a characteristic of the print head from a storage unit (such as ROM or RAM); a data correcting step of allowing a central processing unit (CPU) to correct the N-valued (N(2) data based on the characteristic of the print head grasped in the print-head characteristic grasping step; and a printing step of allowing an output unit to perform the printing based on the corrected data obtained in the data correcting step, wherein when a dot is formed by the use of a normal nozzle and an abnormal nozzle detected in the print-head characteristic grasping step, the data correcting step serves to correct the N-valued (N(2) data so as not to form a dot by the use of the abnormal nozzle and to correct the N-valued (N(2) data so as to form a compensation dot, which has a color different from a color used by the abnormal nozzle, in the vicinity of a dot forming position by the abnormal nozzle.

Accordingly, similar to Aspect 1, since the dots having a different color are formed in a stripe portion (for example, a white stripe portion when the print medium is white) generated due to a flight bending phenomenon or the clogging of a nozzle, the visibility of the white stripe deteriorates and it is thus possible to remove the white stripe or to make the white stripe invisible to the naked eye. In addition, when an ink is jetted from the abnormal nozzle detected in the print-head characteristic grasping step and the normal nozzle adjacent to the abnormal nozzle, the dots are not formed to overlap the dots at the normal position adjacent thereto by stopping the jetting of the ink from the abnormal nozzle. Accordingly, the concentration of the color at the overlapping portion becomes deeper and the disadvantage that the white stripe is emphasized can be avoided, thereby making the white stripe further invisible.

[Aspect 26] According to Aspect 26 of the present invention, there is provided an image forming method of forming a predetermined image with N-valued (N(2) data on a print medium by jetting an ink from a plurality of nozzle modules, which are arranged in a print head by colors, while moving one or both of the print medium and the print head, the image forming method comprising: a N-valued (N(2) data acquiring step of acquiring the N-valued (N(2) data; a print-head characteristic grasping step of grasping a characteristic of the print head; a data correcting step of correcting the N-valued (N(2) data based on the characteristic of the print head grasped in the print-head characteristic grasping step; and a printing step of performing the printing based on the corrected data obtained in the data correcting step, wherein when a dot is formed by the use of an abnormal nozzle detected in the print-head characteristic grasping step, the data correcting step serves to correct the N-valued (N(2) data so as to superpositionally form a compensation dot having a different color by the use of a normal nozzle in a nozzle module for the different color.

Substantially, the image forming method according to Aspect 26 is an image forming method of forming a predetermined image with N-valued ($N \geqq 2$) data on a print medium by jetting an ink from a plurality of nozzle modules, which are arranged in a print head by colors, while moving one or both of the print medium and the print head, the image forming method comprising: a N-valued ($N \geqq 2$) data acquiring step of acquiring the N-valued ($N \geqq 2$) data from an input unit; a print-head characteristic grasping step of grasping a characteristic of the print head from a storage unit (such as ROM or RAM); a data correcting step of allowing a central processing unit (CPU) to correct the N-valued ($N \geqq 2$) data based on the characteristic of the print head grasped in the print-head characteristic grasping step; and a printing step of allowing an output unit to perform the printing based on the corrected data obtained in the data correcting step, wherein when a dot is formed by the use of an abnormal nozzle detected in the print-head characteristic grasping step, the data correcting step serves to correct the N-valued ($N \geqq 2$) data so as to superpositionally form a compensation dot having a different color by the use of a normal nozzle in a nozzle module for the different color.

Accordingly, similar to Aspect 2, since the dots having a different color are formed in a stripe portion generated due to the flight bending phenomenon or the deviation in position of a nozzle, the visibility of the white stripe can deteriorate and thus the white stripe can be made invisible to the naked eye.

[Aspect 27] According to Aspect 27 of the present invention, there is provided the image forming method according to Aspect 25 or 26, further comprising a multi-dot forming step of controlling the print head so as to form the compensation dot greater than the dot formed by the use of a nozzle module including the abnormal nozzle.

Accordingly, similar to Aspect 3, by forming the compensation dot greater than the normal dots, it is possible to form the compensation dot to surely cover the white stripe portion, even when the compensation dot is deviated from the target position but not abnormal, or when the width of the white stripe is great. As a result, similar to the above-mentioned aspect, the visibility of the white stripe portion deteriorates, thereby making the white stripe invisible to the naked eye.

[Aspect 28] According to Aspect 28 of the present invention, there is provided the image forming method according to any one of Aspects 25 to 27, wherein the data correcting steps serves to correct the N-valued (N(2) data so as to form the compensation dot earlier than dots formed by the use of the nozzle module including the abnormal nozzle.

Accordingly, similar to Aspect 4, the visibility of the white stripe portion can deteriorate, thereby making the white stripe invisible to the naked eye. In addition, since the color of the compensation dot is not viewed well, it is possible to satisfactorily avoid the generation of an unnatural color in the white stripe portion.

[Aspect 29] According to Aspect 29 of the present invention, there is provided the image forming method according to any one of Aspects 25 to 28, wherein the data correcting step serves to correct the N-valued (N(2) data so as to form, as the compensation dot, a dot having a color of which the concentration value or the brightness value approaches the concentration value or the brightness value of the dot formed by the use of the abnormal nozzle by a predetermined value or less.

Accordingly, similar to Aspect 5, the visibility of the white stripe can deteriorate, thereby making the white stripe invisible to the naked eye. In addition, since the color of the compensation dot is not viewed well, it is possible to further deteriorate the visibility of the color stripe resulting from the correction.

[Aspect 30] According to Aspect 30 of the present invention, there is provided the image forming method according to any one of Aspects 25 to 28, wherein the data correcting step serves to correct the N-valued (N≧2) data such that when the print head can form a plurality of colors of dots and the color of the dot formed by the use of the abnormal nozzle is black, the compensation dot is formed by combining the plurality of colors.

Accordingly, similar to Aspect 6, since the color having a great difference in concentration with respect to black is not singly selected for the compensation dot, it is possible to satisfactorily deteriorate the visibility of the white stripe.

[Aspect 31] According to Aspect 31 of the present invention, there is provided the image forming method according to any one of Aspects 25 to 28, wherein the data correcting step serves to correct the N-valued (N≧2) data such that when the print head can form dots having four or more colors including black, magenta, cyan, and yellow and the color of the dot formed by the use of the abnormal nozzle is black, a dot having a combination of magenta, cyan, and yellow, a combination of magenta and cyan, a combination of magenta and yellow, a combination of cyan and yellow, or any one of magenta and cyan is formed as the compensation dot.

Accordingly, similar to Aspect 7, since yellow having a greatest difference in concentration with respect to black is not singly selected for the compensation dot, it is possible to satisfactorily deteriorate the visibility of the white stripe.

[Aspect 32] According to Aspect 32 of the present invention, there is provided the image forming method according to any one of Aspects 25 to 28, wherein the data correcting step serves to correct the N-valued (N≧2) data such that when the print head can form dots having four or more colors including black, magenta, cyan, and yellow and the color of the dot formed by the use of the abnormal nozzle is magenta, a dot having a black color, a cyan color, or a combination of cyan and yellow is formed as the compensation dot.

Accordingly, similar to Aspect 8, since the color having a great difference in concentration with respect to magenta is not singly selected for the compensation dot, it is possible to satisfactorily deteriorate the visibility of the white stripe.

[Aspect 33] According to Aspect 33 of the present invention, there is provided the image forming method according to any one of Aspects 25 to 28, wherein the data correcting step serves to correct the N-valued (N__2) data such that when the print head can form dots having four or more colors including black, magenta, cyan, and yellow and the color of the dot formed by the use of the abnormal nozzle is cyan, dots having a black color, a magenta color, or a combination of magenta and yellow is formed as the compensation dot.

Accordingly, similar to Aspects 9, since yellow having a great difference in concentration with respect to cyan is not singly selected for the compensation dot, it is possible to satisfactorily deteriorate the visibility of the white stripe.

[Aspect 34] According to Aspect 34 of the present invention, there is provided the image forming method according to Aspect 31, wherein the data correcting step serves to correct the N-valued (N__2) data such that when the dot formed by the abnormal nozzle is continuous in the printing direction, two or more of a dot having a combination of magenta, cyan, and yellow, a dot having a combination of magenta and cyan, and a dot having one of magenta and cyan are alternately formed as the compensation dot.

Accordingly, similar to Aspect 10, it is possible to avoid the generation of another colored stripe instead of the white stripe, in addition to the white stripe, thereby preventing another colored stripe from being visible.

[Aspect 35] According to Aspect 35 of the present invention, there is provided the image forming method according to any one of Aspects 25 to 34, wherein the print-head characteristic grasping step includes a print-head characteristic storing step of storing nozzle characteristics of the print head in advance, and wherein the print-head characteristic grasping step serves to detect the abnormal nozzle every nozzle module of the print head based on the characteristics of the print head stored in the print-head characteristic storing step.

Accordingly, similar to Aspect 11, since the abnormal nozzle of the print head can be accurately grasped, it is possible to optimally form the compensation dot every print head, similar to the above-mentioned aspects.

[Aspect 36] According to Aspect 36 of the present invention, there is provided the image forming method according to any one of Aspects 25 to 34, wherein the print-head characteristic grasping step includes a print-head characteristic detecting step of detecting the characteristic of the print head from an image formed by the use of the print head, and wherein the print-head characteristic grasping step serves to detect the abnormal nozzle every nozzle module of the print head based on the characteristic of the print head detected in the print-head characteristic detecting step.

Accordingly, similar to Aspect 12, it is possible to rapidly cope with the replacement of the print head. In addition, even when the print head varies in characteristic with use (when a new abnormal nozzle is generated), it is possible to flexibly cope with the variation in characteristic with use, by allowing the print-head characteristic detecting step to serve to detect the characteristic of the print head from an image formed by the use of the print head at a predetermined point of time.

[Aspect 37] According to Aspect 37 of the present invention, there is provided a data generating apparatus for generating N-valued (N≧2) data used for a printer that forms a predetermined image on a print medium by jetting an ink from a plurality of nozzle modules, which are arranged in a print head by colors, while moving one or both of the print medium and the print head, the data generating apparatus comprising: a N-valued data acquiring means for acquiring the N-valued (N≧2) data; a print-head characteristic grasping means for grasping a characteristic of the print head; and a data correcting means for correcting the N-valued (N≧2) data based on the characteristic of the print head grasped by the print-head characteristic grasping means, wherein when a dot is formed by the use of a normal nozzle and an abnormal nozzle detected by the print-head characteristic grasping means, the data correcting means corrects the N-valued (N≧2) data so as not to form a dot by the use of the abnormal nozzle and corrects the N-valued (N≧2) data so as to form a compensation dot, which has a color different from a color used by the abnormal nozzle, in the vicinity of a dot forming position by the abnormal nozzle.

That is, the present aspect provides an apparatus for generating only correction data without the printing means of the image forming apparatus described above. Accordingly, in the apparatus according to the present aspect, only by transmitting the generated correction data to a printer, the conventional inkjet printer can be used as it is. In addition, similar to Aspect 1, it is possible to easily obtain a printed matter with high quality in which the white stripe or the deep-colored stripe is almost invisible.

[Aspect 38] According to Aspect 38 of the present invention, there is provided a data generating apparatus for generating N-valued (N(2) data used for a printer that forms a predetermined image on a print medium by jetting an ink from a plurality of nozzle modules, which are arranged in a print head by colors, while moving one or both of the print medium and the print head, the data generating apparatus comprising: a N-valued data acquiring means for acquiring the N-valued (N(2) data; a print-head characteristic grasping means for grasping a characteristic of the print head; and a data correcting means for correcting the N-valued (N(2) data based on the characteristic of the print head grasped by the print-head characteristic grasping means, wherein when a dot is formed by the use of an abnormal nozzle detected by the print-head characteristic grasping means, the data correcting means corrects the N-valued (N(2) data so as to superpositionally form a compensation dot having a different color by the use of a normal nozzle in a nozzle module for the different color.

Accordingly, similar to Aspect 34, the conventional inkjet printer can be used as it is. In addition, similar to Aspect 2, it is possible to easily obtain a printed matter with high quality in which the white stripe or the deep-colored stripe is almost invisible.

[Aspect 39] According to Aspect 39 of the present invention, there is provided a computer-readable recording medium in which the image forming program according to any one of Aspects 13 to 24 is recorded.

Accordingly, the computer program according to any one of Aspects 13 to 24 can be easily and surely provided to users through the computer-readable recording medium such as CD-ROM, DVD-ROM, FD, a semiconductor chip.

[Aspect 41] According to Aspect 41 of the present invention, there is provided a data generating program for generating N-valued (N(2) data used for a printer that forms a predetermined image on a print medium by jetting an ink from a plurality of nozzle modules, which are arranged in a print head by colors, while moving one or both of the print medium and the print head, the data generating program allowing a computer to serve as: a N-valued data acquiring means for acquiring the N-valued (N≧2) data; a print-head characteristic grasping means for grasping a characteristic of the print head; and a data correcting means for correcting the N-valued (N≧2) data based on the characteristic of the print head grasped by the print-head characteristic grasping means, wherein when a dot is formed by the use of a normal nozzle and an abnormal nozzle detected by the print-head characteristic grasping means, the data correcting means serves to correct the N-valued (N≧2) data so as not to form a dot by the use of the abnormal nozzle and to correct the N-valued (N≧2) data so as to form a compensation dot, which has a color different from a color used by the abnormal nozzle, in the vicinity of a dot forming position by the abnormal nozzle.

Accordingly, it is possible to generate the N-valued (N≧2) data in which the dots having a different color are not formed in the stripe portion (for example, a white stripe portion when the print medium is white) generated due to a flight bending phenomenon or the clogging of a nozzle.

Since the respective means can be embodied in software by the use of PC or a general-purpose computer system, the respective means can be economically and easily embodied in comparison with the case that the respective means are embodied in specific hardware. In addition, by rewriting a part of the program, the version-up due to the change or improvement in functions can be easily accomplished.

[Aspect 42] According to Aspect 42 of the present invention, there is provided a data generating program for generating N-valued (N≧2) data used for a printer that forms a predetermined image on a print medium by jetting an ink from a plurality of nozzle modules, which are arranged in a print head by colors, while moving one or both of the print medium and the print head, the data generating program allowing a computer to serve as: a N-valued data acquiring means for acquiring the N-valued (N≧2) data; a print-head characteristic grasping means for grasping a characteristic of the print head; and a data correcting means for correcting the N-valued (N≧2) data based on the characteristic of the print head grasped by the print-head characteristic grasping means, wherein when a dot is formed by the use of an abnormal nozzle detected by the print-head characteristic grasping means, the data correcting means serves to correct the N-valued (N≧2) data so as to superpositionally form a compensation dot having a different color by the use of a normal nozzle in a nozzle module for the different color.

Accordingly, it is possible to generate the N-valued (N≧2) data in which the dots having a different color are not formed in the stripe portion (for example, a white stripe portion when the print medium is white) generated due to a flight bending phenomenon or the clogging of a nozzle.

Since the respective means can be embodied in software by the use of PC or a general-purpose computer system, the respective means can be economically and easily embodied in comparison with the case that the respective means are embodied in specific hardware. In addition, by rewriting a part of the program, the version-up due to the change or improvement in functions can be easily accomplished.

[Aspect 43] According to Aspect 43 of the present invention, there is provided the data generating program according to Aspect 41 or 42, the data generating program allowing a computer to further execute a multi-dot forming step of controlling the print head so as to form the compensation dot greater than the dot formed by the use of a nozzle module including the abnormal nozzle.

Accordingly, it is possible to generate the N-valued (N≧2) data in which the white stripe is invisible to the naked eye.

Since the respective means can be embodied in software by the use of PC or the general-purpose computer system, the respective means can be economically and easily embodied in comparison with the case that the respective means are embodied in specific hardware. In addition, by rewriting a part of the program, the version-up due to the change or improvement in functions can be easily accomplished.

[Aspect 44] According to Aspect 44 of the present invention, there is provided the data generating program according to any one of Aspects 41 to 43, wherein the data correcting steps serves to correct the N-valued (N≧2) data so as to form the compensation dot earlier than dots formed by the use of the nozzle module including the abnormal nozzle.

Accordingly, the visibility of the white stripe portion can deteriorate, thereby making the white stripe invisible to the naked eye. In addition, since the color of the compensation dot is not viewed well, it is possible to satisfactorily avoid the generation of an unnatural color in the white stripe portion.

Since the respective means can be embodied in software by the use of PC or the general-purpose computer system, the respective means can be economically and easily embodied in comparison with the case that the respective means are embodied in specific hardware. In addition, by rewriting a part of the program, the version-up due to the change or improvement in functions can be easily accomplished.

[Aspect 45] According to Aspect 45 of the present invention, there is provided the data generating program according to any one of Aspects 41 to 44, wherein the data correcting step serves to correct the N-valued (N≧2) data so as to form, as the compensation dot, a dot having a color of which the concentration value or the brightness value approaches the concentration value or the brightness value of the dot formed by the use of the abnormal nozzle by a predetermined value or less.

Accordingly, the visibility of the white stripe can deteriorate, thereby making the white stripe invisible to the naked eye. In addition, since the color of the compensation dot is not viewed well, it is possible to further deteriorate the visibility of the color stripe resulting from the correction.

Since the respective means can be embodied in software by the use of PC or the general-purpose computer system, the respective means can be economically and easily embodied in comparison with the case that the respective means are embodied in specific hardware. In addition, by rewriting a part of the program, the version-up due to the change or improvement in functions can be easily accomplished.

[Aspect 46] According to Aspect 46 of the present invention, there is provided the data generating program according to any one of Aspects 41 to 44, wherein the data correcting step serves to correct the N-valued (N≧2) data such that when the print head can form a plurality of colors of dots and the color of the dot formed by the use of the abnormal nozzle is black, the compensation dot is formed by combining the plurality of colors.

Accordingly, since the color having a great difference in concentration with respect to black is not singly selected for the compensation dot, it is possible to satisfactorily deteriorate the visibility of the white stripe.

Since the respective means can be embodied in software by the use of PC or the general-purpose computer system, the respective means can be economically and easily embodied in comparison with the case that the respective means are embodied in specific hardware. In addition, by rewriting a part of the program, the version-up due to the change or improvement in functions can be easily accomplished.

[Aspect 47] According to Aspect 47 of the present invention, there is provided the data generating program according to any one of Aspects 41 to 44, wherein the data correcting step serves to correct the N-valued (N≧2) data such that when the print head can form dots having four or more colors including black, magenta, cyan, and yellow and the color of the dot formed by the use of the abnormal nozzle is black, a dot having a combination of magenta, cyan, and yellow, a combination of magenta and cyan, a combination of magenta and yellow, a combination of cyan and yellow, or any one of magenta and cyan is formed as the compensation dot.

Accordingly, since yellow having a greatest difference in concentration with respect to black is not singly selected for the compensation dot, it is possible to satisfactorily deteriorate the visibility of the white stripe.

Since the respective means can be embodied in software by the use of PC or the general-purpose computer system, the respective means can be economically and easily embodied in comparison with the case that the respective means are embodied in specific hardware. In addition, by rewriting a part of the program, the version-up due to the change or improvement in functions can be easily accomplished.

[Aspect 48] According to Aspect 48 of the present invention, there is provided the data generating program according to any one of Aspects 41 to 44, wherein the data correcting step serves to correct the N-valued (N≧2) data such that when the print head can form dots having four or more colors including black, magenta, cyan, and yellow and the color of the dot formed by the use of the abnormal nozzle is magenta, a dot having a black color, a cyan color, or a combination of cyan and yellow is formed as the compensation dot.

Accordingly, since the color having a great difference in concentration with respect to magenta is not singly selected for the compensation dot, it is possible to satisfactorily deteriorate the visibility of the white stripe.

Since the respective means can be embodied in software by the use of PC or the general-purpose computer system, the respective means can be economically and easily embodied in comparison with the case that the respective means are embodied in specific hardware. In addition, by rewriting a part of the program, the version-up due to the change or improvement in functions can be easily accomplished.

[Aspect 49] According to Aspect 49 of the present invention, there is provided the data generating program according to any one of Aspects 41 to 44, wherein the data correcting step serves to correct the N-valued (N≧2) data such that when the print head can form dots having four or more colors including black, magenta, cyan, and yellow and the color of the dot formed by the use of the abnormal nozzle is cyan, dots having a black color, a magenta color, or a combination of magenta and yellow is formed as the compensation dot.

Accordingly, since yellow having a great difference in concentration with respect to cyan is not singly selected for the compensation dot, it is possible to satisfactorily deteriorate the visibility of the white stripe.

Since the respective means can be embodied in software by the use of PC or the general-purpose computer system, the respective means can be economically and easily embodied in comparison with the case that the respective means are embodied in specific hardware. In addition, by rewriting a part of the program, the version-up due to the change or improvement in functions can be easily accomplished.

[Aspect 50] According to Aspect 50 of the present invention, there is provided the data generating program according to Aspect 49, wherein the data correcting step serves to correct the N-valued (N≧2) data such that when the dot formed by the abnormal nozzle is continuous in the printing direction, two or more of a dot having a combination of magenta, cyan, and yellow, a dot having a combination of magenta and cyan, and a dot having one of magenta and cyan are alternately formed as the compensation dot.

Accordingly, it is possible to avoid the generation of another colored stripe instead of the white stripe, in addition to the white stripe, thereby preventing another colored stripe from being visible.

Since the respective means can be embodied in software by the use of PC or the general-purpose computer system, the respective means can be economically and easily embodied in comparison with the case that the respective means are embodied in specific hardware. In addition, by rewriting a part of the program, the version-up due to the change or improvement in functions can be easily accomplished.

[Aspect 51] According to Aspect 51 of the present invention, there is provided the data generating program according to any one of Aspects 41 to 50, wherein the print-head characteristic grasping step includes a print-head characteristic storing step of storing nozzle characteristics of the print head in advance, and wherein the print-head characteristic grasping step serves to detect the abnormal nozzle every nozzle module of the print head based on the characteristics of the print head stored in the print-head characteristic storing step.

Accordingly, since the abnormal nozzle of the print head can be accurately grasped, it is possible to optimally form the compensation dot every print head, similar to the above-mentioned aspects.

Since the respective means can be embodied in software by the use of PC or the general-purpose computer system, the respective means can be economically and easily embodied in comparison with the case that the respective means are embodied in specific hardware. In addition, by rewriting a part of the program, the version-up due to the change or improvement in functions can be easily accomplished.

[Aspect 52] According to Aspect 52 of the present invention, there is provided the data generating program according to any one of Aspects 41 to 51, wherein the print-head characteristic grasping step includes a print-head characteristic detecting step of detecting the characteristic of the print head from an image formed by the use of the print head, and wherein the print-head characteristic grasping step serves to detect the abnormal nozzle every nozzle module of the print head based on the characteristic of the print head detected in the print-head characteristic detecting step.

Accordingly, it is possible to rapidly cope with the replacement of the print head. In addition, even when the print head varies in characteristic with use (when a new abnormal nozzle is generated), it is possible to flexibly cope with the variation in characteristic with use, by allowing the print-head characteristic detecting step to serve to detect the characteristic of the print head from an image formed by the use of the print head at a predetermined point of time.

Since the respective means can be embodied in software by the use of PC or the general-purpose computer system, the respective means can be economically and easily embodied in comparison with the case that the respective means are embodied in specific hardware. In addition, by rewriting a part of the program, the version-up due to the change or improvement in functions can be easily accomplished.

[Aspect 53] According to Aspect 53 of the present invention, there is provided a computer-readable recording medium in which the data generating program according to any one of Aspects 41 to 52 is recorded.

Accordingly, the printing program according to any one of Aspects 41 to 52 can be easily and surely provided to users through the computer-readable recording medium such as CD-ROM, DVD-ROM, FD, a semiconductor chip.

[Aspect 54] According to Aspect 54 of the present invention, there is provided a data generating method of generating N-valued (N≧2) data used for a printer that forms a predetermined image on a print medium by jetting an ink from a plurality of nozzle modules, which are arranged in a print head by colors, while moving one or both of the print medium and the print head, the data generating method comprising: a N-valued data acquiring step of acquiring the N-valued (N≧2) data; a print-head characteristic grasping step of grasping a characteristic of the print head; and a data correcting step of correcting the N-valued (N≧2) data based on the characteristic of the print head grasped in the print-head characteristic grasping step, wherein when a dot is formed by the use of a normal nozzle and an abnormal nozzle detected in the print-head characteristic grasping step, the data correcting step serves to correct the N-valued (N≧2) data so as not to form a dot by the use of the abnormal nozzle and to correct the N-valued (N≧2) data so as to form a compensation dot, which has a color different from a color used by the abnormal nozzle, in the vicinity of a dot forming position by the abnormal nozzle.

Accordingly, it is possible to generate the N-valued (N≧2) data in which the dots having a different color are not formed in the stripe portion (for example, a white stripe portion when the print medium is white) generated due to a flight bending phenomenon or the clogging of a nozzle.

[Aspect 55] According to Aspect 55 of the present invention, there is provided a data generating method of generating N-valued (N≧2) data used for a printer that forms a predetermined image on a print medium by jetting an ink from a plurality of nozzle modules, which are arranged in a print head by colors, while moving one or both of the print medium and the print head, the data generating method comprising: a N-valued data acquiring step of acquiring the binary data; a print-head characteristic grasping step of grasping a characteristic of the print head; and a data correcting step of correcting the N-valued (N≧2) data based on the characteristic of the print head grasped in the print-head characteristic grasping step, wherein when a dot is formed by the use of an abnormal nozzle detected by the print-head characteristic grasping step, the data correcting step serves to correct the N-valued (N≧2) data so as to superpositionally form a compensation dot having a different color by the use of a normal nozzle in a nozzle module for the different color.

Accordingly, it is possible to generate the N-valued (N≧2) data in which the dots having a different color are not formed in the stripe portion (for example, a white stripe portion when the print medium is white) generated due to a flight bending phenomenon or the clogging of a nozzle.

[Aspect 56] According to Aspect 56 of the present invention, there is provided the data generating method according to Aspect 54 or 55, wherein the compensation dot is formed greater than the dot formed by the use of a nozzle module including the abnormal nozzle.

Accordingly, it is possible to generate the N-valued (N≧2) data in which the white stripe is invisible to the naked eye.

[Aspect 57] According to Aspect 57 of the present invention, there is provided the data generating method according to any one of Aspects 54 to 56, wherein the data correcting steps serves to correct the N-valued (N≧2) data so as to form the compensation dot earlier than dots formed by the use of the nozzle module including the abnormal nozzle.

Accordingly, the visibility of the white stripe portion can deteriorate, thereby making the white stripe invisible to the naked eye. In addition, since the color of the compensation dot is not viewed well, it is possible to satisfactorily avoid the generation of an unnatural color in the white stripe portion.

[Aspect 58] According to Aspect 58 of the present invention, there is provided the data generating method according to any one of Aspects 54 to 57, wherein the data correcting step serves to correct the N-valued (N≧2) data so as to form, as the compensation dot, a dot having a color of which the concentration value or the brightness value approaches the concentration value or the brightness value of the dot formed by the use of the abnormal nozzle by a predetermined value or less.

Accordingly, the visibility of the white stripe can deteriorate, thereby making the white stripe invisible to the naked eye. In addition, since the color of the compensation dot is not viewed well, it is possible to further deteriorate the visibility of the color stripe resulting from the correction.

[Aspect 59] According to Aspect 59 of the present invention, there is provided the data generating method according to any one of Aspects 54 to 57, wherein the data correcting step serves to correct the N-valued (N≧2) data such that when the print head can form a plurality of colors of dots and the color of the dot formed by the use of the abnormal nozzle is black, the compensation dot is formed by combining the plurality of colors.

Accordingly, since the color having a great difference in concentration with respect to black is not singly selected for the compensation dot, it is possible to satisfactorily deteriorate the visibility of the white stripe.

[Aspect 60] According to Aspect 60 of the present invention, there is provided the data generating method according to any one of Aspects 54 to 57, wherein the data correcting step serves to correct the N-valued (N≧2) data such that when the print head can form dots having four or more colors including black, magenta, cyan, and yellow and the color of the dot formed by the use of the abnormal nozzle is black, a dot having a combination of magenta, cyan, and yellow, a combination of magenta and cyan, a combination of magenta and yellow, a combination of cyan and yellow, or any one of magenta and cyan is formed as the compensation dot.

Accordingly, since yellow having a greatest difference in concentration with respect to black is not singly selected for the compensation dot, it is possible to satisfactorily deteriorate the visibility of the white stripe.

[Aspect 61] According to Aspect 61 of the present invention, there is provided the data generating method according to any one of Aspects 54 to 57, wherein the data correcting step serves to correct the N-valued (N≧2) data such that when the print head can form dots having four or more colors including black, magenta, cyan, and yellow and the color of the dot formed by the use of the abnormal nozzle is magenta, a dot having a black color, a cyan color, or a combination of cyan and yellow is formed as the compensation dot.

Accordingly, since the color having a great difference in concentration with respect to magenta is not singly selected for the compensation dot, it is possible to satisfactorily deteriorate the visibility of the white stripe.

[Aspect 62] According to Aspect 62 of the present invention, there is provided the data generating method according to any one of Aspects 54 to 57, wherein the data correcting step serves to correct the N-valued (N≧2) data such that when the print head can form dots having four or more colors including black, magenta, cyan, and yellow and the color of the dot formed by the use of the abnormal nozzle is cyan, dots having a black color, a magenta color, or a combination of magenta and yellow is formed as the compensation dot.

Accordingly, since yellow having a great difference in concentration with respect to cyan is not singly selected for the compensation dot, it is possible to satisfactorily deteriorate the visibility of the white stripe.

[Aspect 63] According to Aspect 63 of the present invention, there is provided the data generating method according to Aspect 60, wherein the data correcting step serves to correct the N-valued (N≧2) data such that when the dot formed by the abnormal nozzle is continuous in the printing direction, two or more of a dot having a combination of magenta, cyan, and yellow, a dot having a combination of magenta and cyan, and a dot having one of magenta and cyan are alternately formed as the compensation dot.

Accordingly, it is possible to avoid the generation of another colored stripe instead of the white stripe, in addition to the white stripe, thereby preventing another colored stripe from being visible.

[Aspect 64] According to Aspect 64 of the present invention, there is provided the data generating method according to any one of Aspects 54 to 63, wherein the print-head characteristic grasping step includes a print-head characteristic storing step of storing nozzle characteristics of the print head in advance, and wherein the print-head characteristic grasping step serves to detect the abnormal nozzle every nozzle module of the print head based on the characteristics of the print head stored in the print-head characteristic storing step.

Accordingly, since the abnormal nozzle of the print head can be accurately grasped, it is possible to optimally form the compensation dot every print head, similar to the above-mentioned aspects.

[Aspect 65] According to Aspect 65 of the present invention, there is provided the data generating method according to any one of Aspects 54 to 64, wherein the print-head characteristic grasping step includes a print-head characteristic detecting step of detecting the characteristic of the print head from an image formed by the use of the print head, and wherein the print-head characteristic grasping step serves to detect the abnormal nozzle every nozzle module of the print head based on the characteristic of the print head detected in the print-head characteristic detecting step.

Accordingly, it is possible to rapidly cope with the replacement of the print head. In addition, even when the print head varies in characteristic with use (when a new abnormal nozzle is generated), it is possible to flexibly cope with the variation in characteristic with use, by allowing the print-head characteristic detecting step to serve to detect the characteristic of the print head from an image formed by the use of the print head at a predetermined point of time.

[Aspect 66] According to Aspect 66 of the present invention, there is provided an image forming apparatus that forms a predetermined image with binary data on a print medium by jetting an ink from a plurality of nozzle modules, which are arranged in a print head by colors, while moving one or both of the print medium and the print head, the image forming apparatus comprising: a binary data acquiring means for acquiring the binary data; a print-head characteristic grasping means for grasping a characteristic of the print head; a data correcting means for correcting the binary data based on the characteristic of the print head grasped by the print-head characteristic grasping means; and a printing means for performing the printing based on the corrected data output from the data correcting means, wherein when a dot is formed by the use of a normal nozzle and an abnormal nozzle detected by the print-head characteristic grasping means, the data correcting means corrects the binary data so as not to form a dot by the use of the abnormal nozzle and corrects the binary data so as to form a compensation dot, which has a color different from a color used by the abnormal nozzle, in the vicinity of a dot forming position by the abnormal nozzle.

Accordingly, similar to Aspect 1, since the dots having a different color are formed in the stripe portion (for example, a white stripe portion when the print medium is white) generated due to the flight bending phenomenon or the clogging of a nozzle, the visibility of the white stripe deteriorates and it is thus possible to remove the white stripe or to make the white stripe invisible to the naked eye.

When an ink is jetted from the abnormal nozzle detected by the print-head characteristic grasping means and the normal nozzle adjacent to the abnormal nozzle, the dots are not formed by the use of the abnormal nozzle, for example, by stopping the jetting of the ink from the abnormal nozzle. Accordingly, since the dots are not formed to overlap the dots at the normal position adjacent thereto, the deep-colored stripe generated at the overlapping portion can be simultaneously removed.

As a result, it is possible to obtain a printed matter with high quality in which the white stripe or the deep-colored stripe is almost invisible to the naked eye, even by the use of the print head generating the flight bending phenomenon or the deviation in position of the nozzles. In addition, the conventional inkjet printer can be used as the printing means without any change.

BEST MODE FOR CARRYING OUT THE INVENTION

Hereinafter, best modes for carrying out the present invention will be described in detail with reference to the accompanying drawings.

Figure 1:
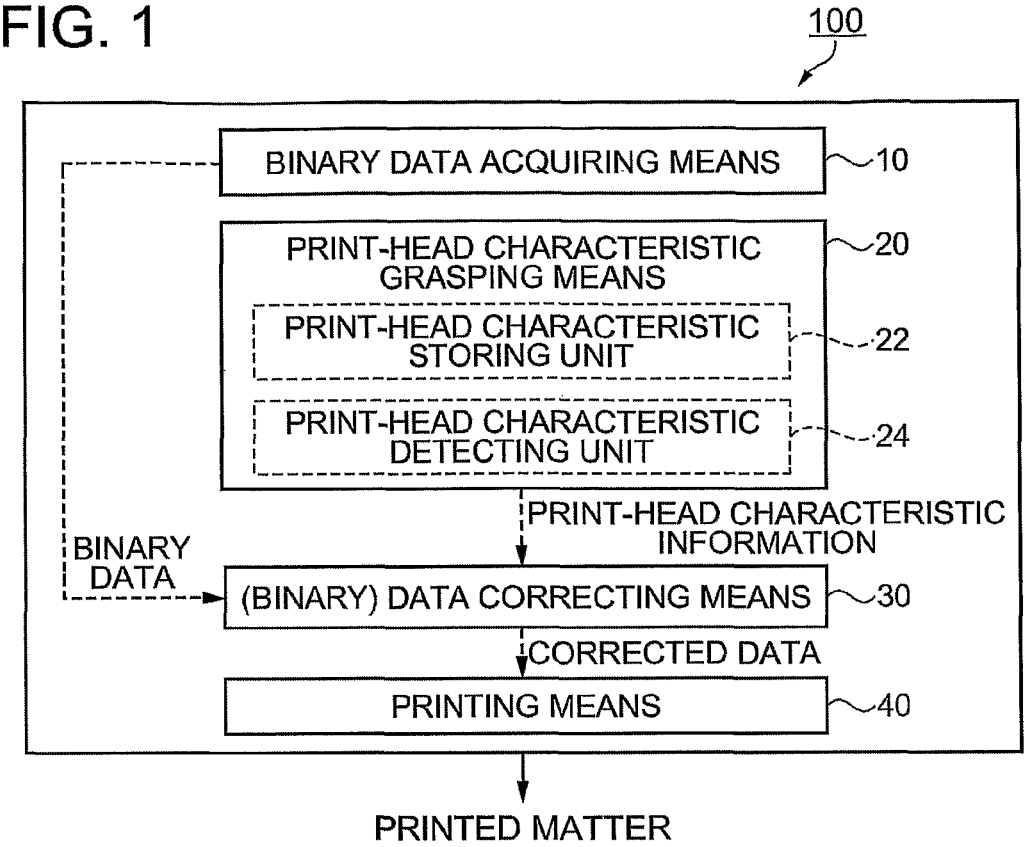
FIG. 1 is a functional block diagram illustrating an embodiment of an image forming apparatus according to the present invention.

FIG. 1 is a functional block diagram illustrating a first embodiment of an image forming apparatus 100 according to the present invention.

As shown in the figure, the image forming apparatus 100 approximately includes a binary data acquiring means 10 that acquires binary data, a print-head characteristic grasping means 20 that grasps a characteristic of a print head 200 to be described later, a data correcting means 30 that corrects the binary data based on the characteristic of the print head grasped by the print-head characteristic grasping means 20, and an inkjet type printing means 40 that performs a printing based on the corrected data output from the data correcting means 30.

First, the binary data acquiring means 10 provides a function of acquiring binary data for printing used in the inkjet printing means 40 to be described later, that is, data on whether a predetermined color of dot should be applied to each pixel or not, directly from a print instructing apparatus such as a personal computer not shown or converting printing data transmitted from the print instructing apparatus into binary data which can be used in the printing means 40 to be described later. As described above, the binary data includes information (N-valued) on the size of a dot at the time of application of the dot, as well as information on "whether a predetermined color of dot should be applied to each pixel".

The print-head characteristic grasping means 20 provides a function of grasping (acquiring) a characteristic of the print head 200 used in the inkjet printing means 40 to be described later. More particularly, as shown in FIGS. 4 and 5, the print-head characteristic grasping means 20 serves to check whether the flight bending phenomenon occurs in the print head 200 used in the printing means 40 and to concretely specify an abnormal nozzle N causing the flight bending phenomenon when the flight bending phenomenon occurs.

Figure 4:
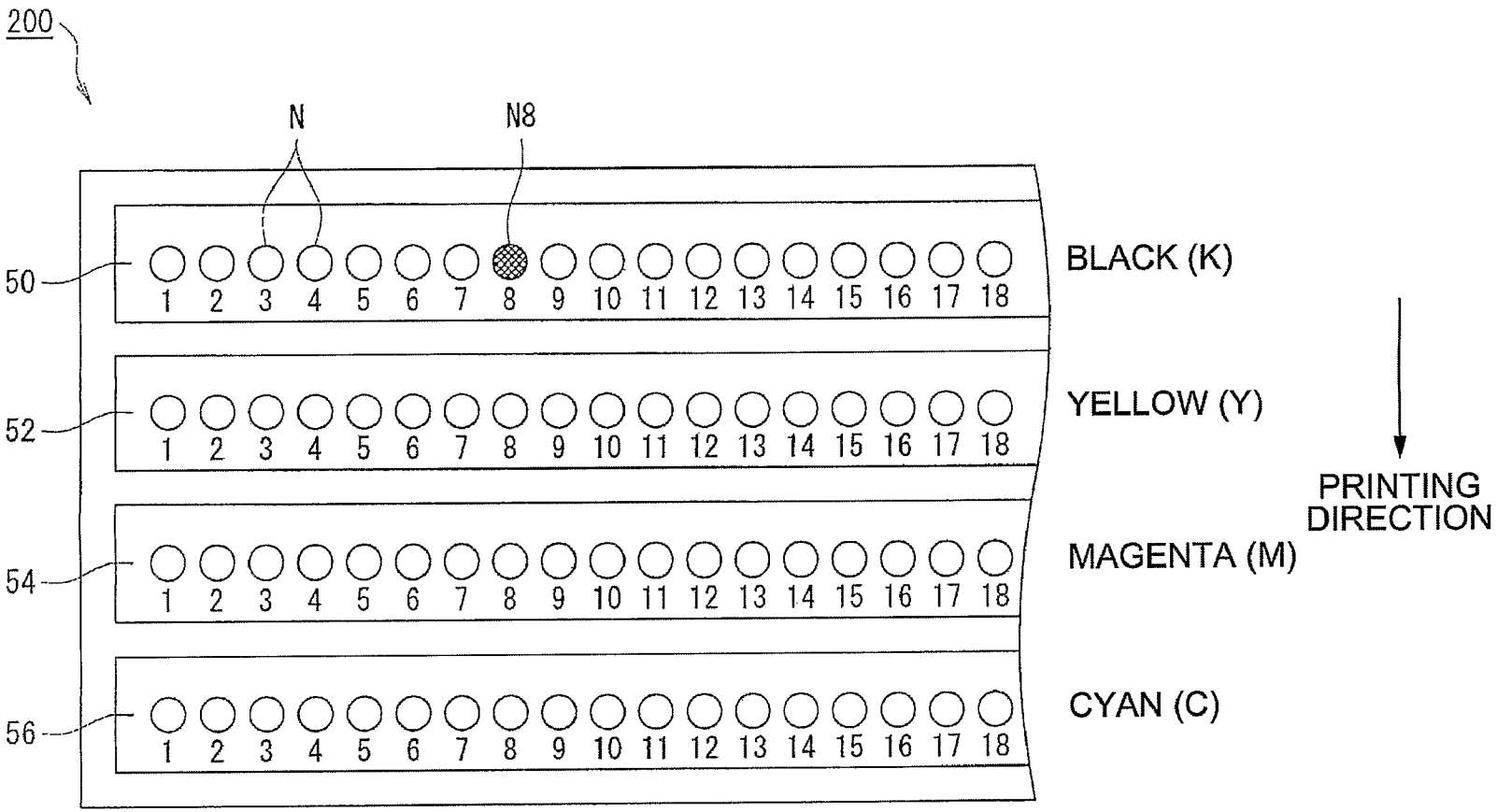
FIG. 4 is a partially enlarged bottom view illustrating a structure of a print head which is an object of the present invention.
Figure 5:
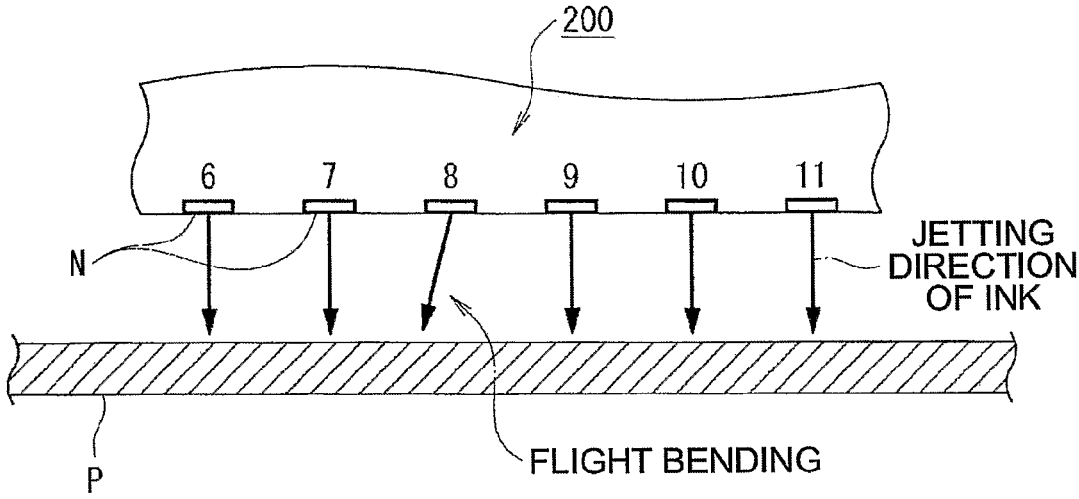
FIG. 5 is a partially enlarged side view illustrating a structure of the print head which is an object of the present invention.

FIG. 4 is a partially enlarged bottom view illustrating a structure of the print head 200 which is an object of the present invention and FIG. 5 is a partially enlarged side view thereof.

As shown in FIG. 4, the print head 200 includes four nozzle modules 50, 52, 54, and 56: a black nozzle module 50 in which a plurality of nozzles N (18 in the figure) jetting only a black (K) ink are arranged in a straight line, a yellow nozzle module 52 in which a plurality of nozzles, N jetting only a yellow (Y) ink are arranged in a straight line, a magenta nozzle module 54 in which a plurality of nozzles N jetting only a magenta (M) ink are arranged in a straight line, and a cyan nozzle module 56 in which a plurality of nozzles N jetting only a cyan (C) ink are arranged in a straight line, which are integrally arranged to overlap with each other in the printing direction.

FIG. 5 shows a state that the eighth nozzle N8 from the left end in the black nozzle module 50 of the four nozzle modules 50, 52, 54, and 56 causes the flight bending phenomenon and the ink is jetted oblique from the nozzle N8 to form a dot in the vicinity of the normal nozzle N7 neighboring thereto.

The print-head characteristic grasping means 20 is provided with a print-head characteristic storing unit 22 or a print-head characteristic detecting unit 24. By reading out the characteristic of the print head 200 stored in advance in the print-head characteristic storing unit 22 or reading out the characteristic of the print head 200 detected by the print-head characteristic detecting unit 24, the print-head characteristic grasping means 20 can easily grasp the characteristic of the print head 200 as needed.

Here, the print-head characteristic storing unit 22 is composed of a storage means such as readable ROM or RAM in which the result of a print-head characteristic test carried out at the time of manufacturing the print head 200 is written. The print-head characteristic detecting unit 24 detects the characteristic of the print head 200 from the printing result by the print head 200 using a scanner means periodically or at the predetermined time and stores the test result along with the data of the print-head characteristic storing unit 22 or by overwriting the data, so as to cope with the change in the characteristic of the print head 200 after use for a predetermined period of time.

When dots are formed by the use of the abnormal nozzle detected by the print-head characteristic grasping means 20 and a normal nozzle adjacent to the abnormal nozzle, the data correcting means 30 provides a function of correcting the binary data so as not to form the dots by the use of the abnormal nozzle and correcting the binary data so as to form compensation dots having a different color by the use of a normal nozzle positioned in the vicinity of the abnormal nozzle in a nozzle module having the different color.

The printing means 40 is an inkjet printer which forms a predetermined image composed of a plurality of dots on the print medium by jetting the ink in the form of dots from the nozzle modules 50, 52, 54, and 56 provided in the print head 200 while moving one or both of the print medium (sheet) and the print head 200. The printing means includes, in addition to the print head 200, a print head transfer mechanism (in case of multi pass type) not shown for reciprocating the print head 200 over the print medium (sheet) in its width direction, a sheet transfer mechanism not shown for moving the print medium (sheet), and a print control mechanism not shown for controlling the jetting of the ink from the print head 200 based on the binary data.

Figure 2:
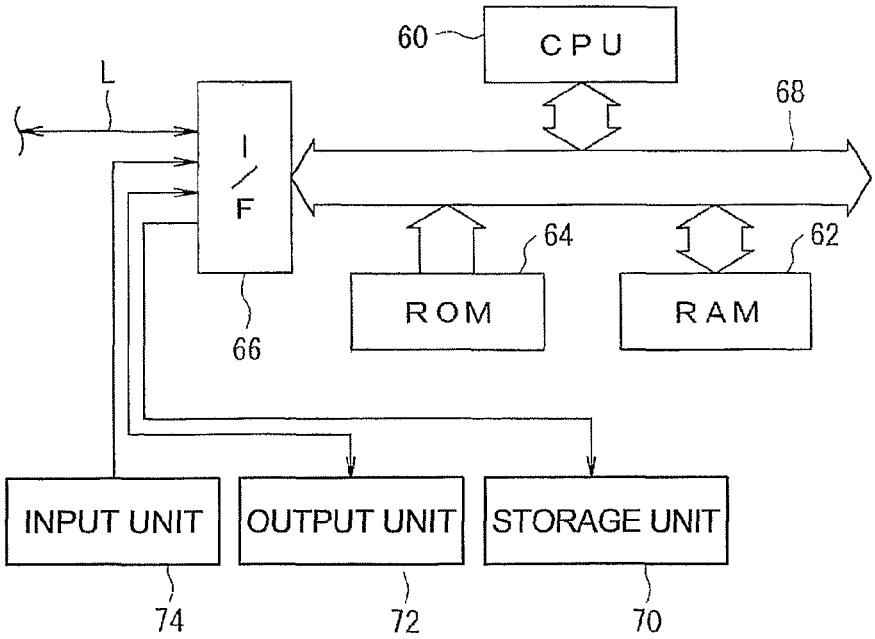
FIG. 2 is a block diagram illustrating a hardware configuration of a computer system which embodies the image forming apparatus according to the present invention.

The image forming apparatus 100 includes a computer system for embodying various controls for printing or the binary data acquiring means 10, the print-head characteristic grasping means 20, and the data correcting means 30 in software. In the hardware structure, as shown in FIG. 2, various outer or inner buses 68 such as PCI (Peripheral Component Interconnect) buses or ISA (Industrial Standard Architecture) buses connect CPU (Central Processing Unit) 60 for carrying out various controls or operations, RAM (Random Access Memory) 62 constituting a main storage, and ROM (Read Only Memory) 64 to each other. In addition, an outer storage (secondary storage) 70 such as HDD, an output unit 72 such as the printing means 40, CRT, and an LCD monitor, an input unit 74 such as a manipulation panel, a mouse, a keyboard, and a scanner, and a network L for communicating with the print instructing apparatus not shown are connected to the buses 68 through an input and output interface (I/F) 66.

When it is powered on, the functions described above embodied in software, by allowing the system program such as BIOS stored in the ROM 64 to load various specific computer programs stored in advance in the ROM 64 or various specific computer programs installed in the storage 70 through a storage medium such as CD-ROM, DVD-ROM, and FD (Flexible Disk) or through the communication network L such as Internet into the RAM 62 and allowing the CPU 60 to carry out predetermined controls and operations by the use of a variety of resources in response to instructions prescribed in the programs loaded into the RAM 62.

Now, an example of a processing flow of an image forming method using the image forming apparatus 100 having the above-mentioned construction will be described mainly with reference to the flowchart of FIG. 3.

First, the image forming apparatus 100 performs the first step S100 when it is powered on and then predetermined initial actions for printing are finished. When a print instructing terminal such as PC is connected thereto, the binary data acquiring means 10 monitors whether a clear print instruction is given from the print instructing terminal. When it is determined that the print instruction is given (Yes), the next step S102 is performed, thereby checking whether binary data for printing are transmitted along with the print instruction from the print instructing terminal.

As a result, when it is determined that the binary data for printing is transmitted (Yes), the next step S104 is performed and the print-head characteristic grasping means 20 grasps (acquires) the characteristic of the print head 200 of the printing means 40. When it is determined even after waiting for a predetermined period of time that the printing data are not transmitted (No), it is replied to the print instructing terminal that the printing is impossible and then the process is ended.

Then, a next step S106 is performed and when it is determined based on the characteristic of the print head 200 grasped in the step S104 that the flight bending phenomenon occurs (Yes), a next step S108 is performed. A necessary data correcting process is performed to the binary data in the step S108 and then in a next step S110, the corrected binary data are output as the printing data for the printing means 40.

On the other hand, when it is determined in the step S106 that the flight bending phenomenon does not occur (No), the step S110 is performed and the transmitted binary data are output as the printing data for the printing means 40 as it is.

Finally, in a step S112, the printing is performed by the printing means 40 based on the output binary data and then the procedure is finished.

FIGS. 6 to 11 show an example of the data correcting process in the step S108.

Figure 6:
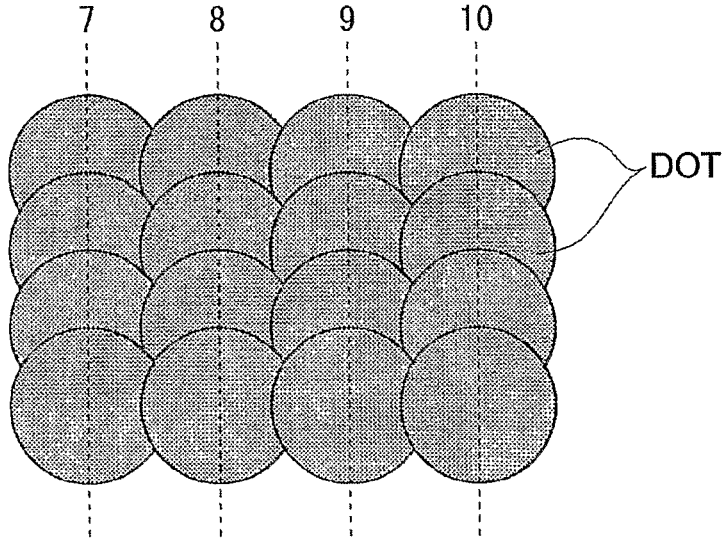
FIG. 6 is a conceptual diagram illustrating an example of a dot pattern formed by a normal print head, which does not cause a flight bending phenomenon.
Figure 7:
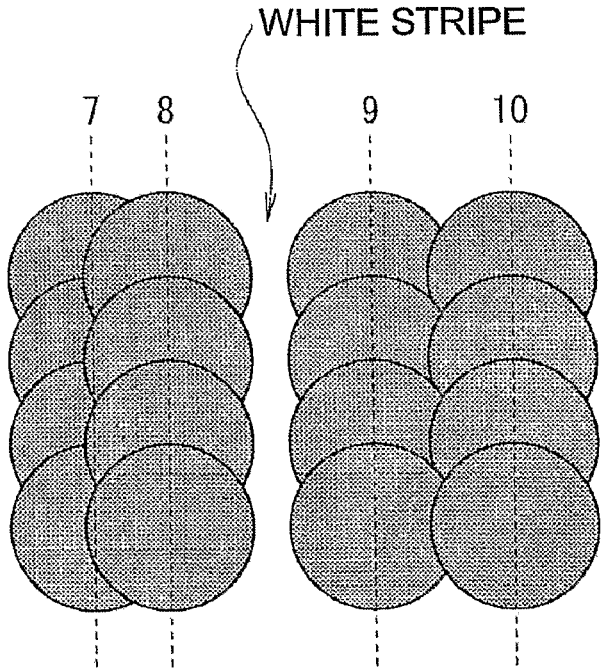
FIG. 7 is a conceptual diagram illustrating an example of a dot pattern formed through the flight bending phenomenon of one nozzle.

FIG. 6 shows an example of a dot pattern (full application) formed only by the use of the black nozzle module 50 of the normal print head 200 with no abnormal nozzle causing the flight bending phenomenon shown in FIG. 4. FIG. 7 shows a state where the nozzle N8 in the black nozzle module 50 causes the flight bending phenomenon and the dots formed by the use of the nozzle N8 are deviated toward the dots formed by the normal nozzle N7 adjacent to the left side thereof as shown in FIG. 5. As a result, a "white stripe" is generated between the dots formed by the use of the nozzle N8 and the dots formed by the use of the nozzle N9 adjacent to the right side thereof. The "white stripe" is a printed matter of "full application" as shown in FIG. 6 and is remarkably visible to the naked eye in case of a combination having extremely different brightness such as a case where the print sheet is white and the ink is black, thereby extremely deteriorating the quality of the printed matter.

Figure 8:
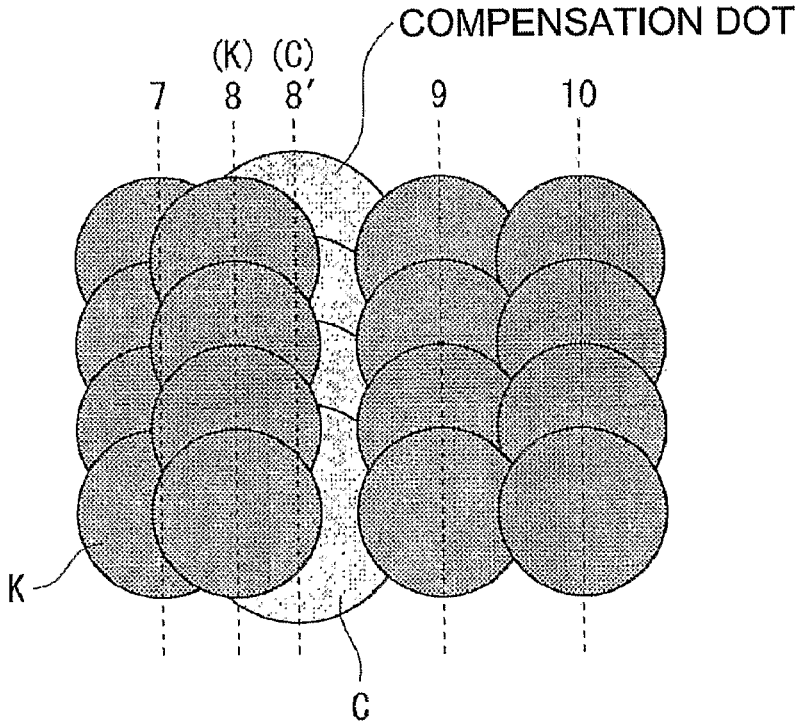
FIG. 8 is a conceptual diagram illustrating an example of a dot pattern formed by the use of the image processing method according to the present invention.

As a result, in the data correcting process according to the present invention, the data are corrected so as to form compensation dots having a different color at the position by the use of the nozzle N positioned at the same position as the nozzle N causing the flight bending phenomenon in another nozzle module as shown in FIG. 4. Accordingly, as shown in FIG. 8, the "white stripe" portion is covered and thus can disappear or almost be invisible to the naked eye.

At this time, by correcting the data so as to select a color having a small difference in brightness or concentration in comparison with that of the dots causing the flight bending as the color of the compensation dots, it is possible to more effectively make the "white stripe" portion invisible to the naked eye.

By allowing the size of the compensation dost to be greater than the general dot size, it is possible to surely cover the "white stripe" portion even when the nozzle forming the compensation dots causes the flight bending phenomenon.

It may be impossible due to the positional relationship between the nozzle modules 50, 52, 54, and 56. However, by correcting the data so as to first form the compensation dots, it is possible to avoid the possibility of making the compensation dots visible to the naked eye.

In the example shown in FIG. 8, since the black nozzle N8 causes the flight bending phenomenon, an example where the data correcting is performed such that the cyan nozzle N8 having the smallest difference in brightness with respect to black is selected among the yellow nozzle N8, the magenta nozzle N8, and the cyan nozzle N8 in the same column as the black nozzle N8 from the other nozzle modules 52, 54, and 56 (that is, the yellow nozzle having the largest difference in brightness with respect to black is not selected) and the compensation dots (large dots) 8' are first formed in that position by the use of the cyan nozzle N8. Accordingly, the "white stripe" portion is covered and thus is removed or is almost invisible to the naked eye.

In the case shown in FIG. 7, a case that the data correcting is performed so as to make the size of the dots formed by the use of the black nozzle N8, which causes the flight bending phenomenon, large enough to cover the "white stripe" portion may be considered. However, in this case, the amount of superposition on the normal dots at the left side thereof increases and the concentration of that portion increases, thereby generating a "deep-colored" stripe. This is not preferable because it greatly deteriorates the image quality, similar to the "white stripe".

The size of dots formed by the use of the respective nozzles N can be easily changed by adding a multi-dot forming means not shown to the print head 200 and controlling the amount of ink jetted from the multi-dot forming means. For example, when the print head is provided with a piezoelectric actuator, it is possible to easily form the dots having any size by changing the voltage applied to the piezoelectric actuator.

Figure 9:
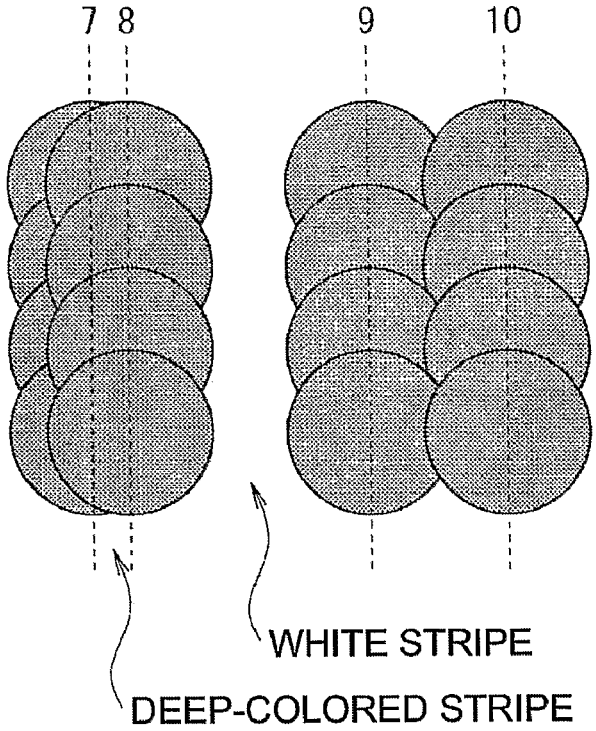
FIG. 9 is a conceptual diagram illustrating an example of a dot pattern formed through the flight bending phenomenon of one nozzle.

Next, as shown in FIG. 9, when the flight bending phenomenon extremely goes on and the dots formed by the use of the black nozzle N8 are almost overlapped on the dots formed by the use of the black nozzle N7 located at the left side thereof, the "deep-colored stripe" as well as the "white stripe" described above are simultaneously generated, because the concentration of the overlapped portion becomes greater.

Figure 10:
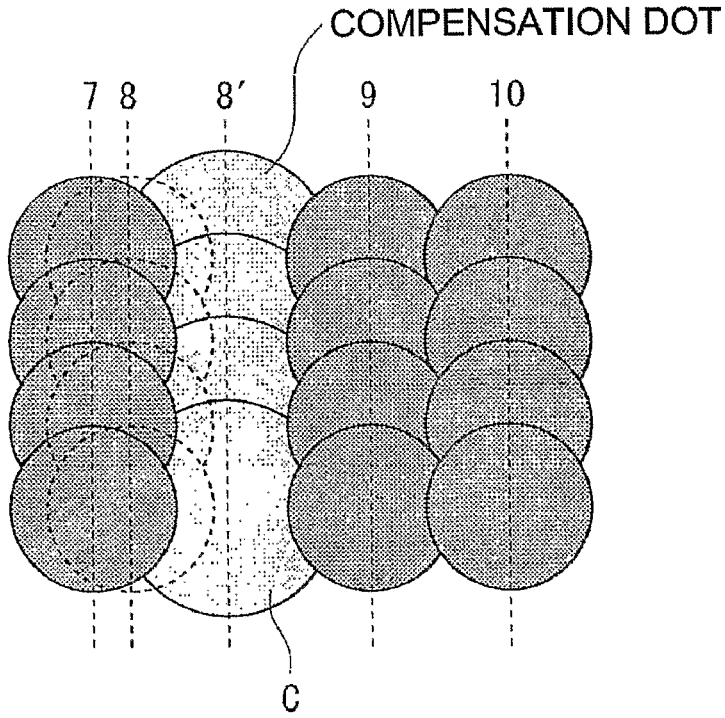
FIG. 10 is a conceptual diagram illustrating an example of a dot pattern formed by the use of the image forming method according to the present invention.

Accordingly, when the flight bending phenomenon extremely goes on and the dots due to the phenomenon are greatly overlapped on other dots, the "deep-colored stripe as well as the "white stripe" can be removed or made invisible to the naked eye, by correcting the data so as to form the dots having a different color in that portion as described above and not to form the dots resulting in the great overlapping (by the use of the nozzle N8) as shown in FIG. 10. When the flight bending phenomenon extremely goes on and the dots due to the phenomenon are greatly overlapped on other dots, the data correcting may be performed so as to form the dots by the use of the nozzle N8 causing the flight bending phenomenon, but not by the use of the normal nozzle N7 overlapped therewith. Then, even when the nozzle N7 is clogged, it is possible to effectively use the nozzle N8.

When the compensation dots are formed as shown in FIGS. 8 and 10, it is preferable that the compensation dots having a color with a small difference in brightness with respect to the original dots should be selected. However, when the same color is selected, it is considered that the color forms a stripe.

Figure 11:
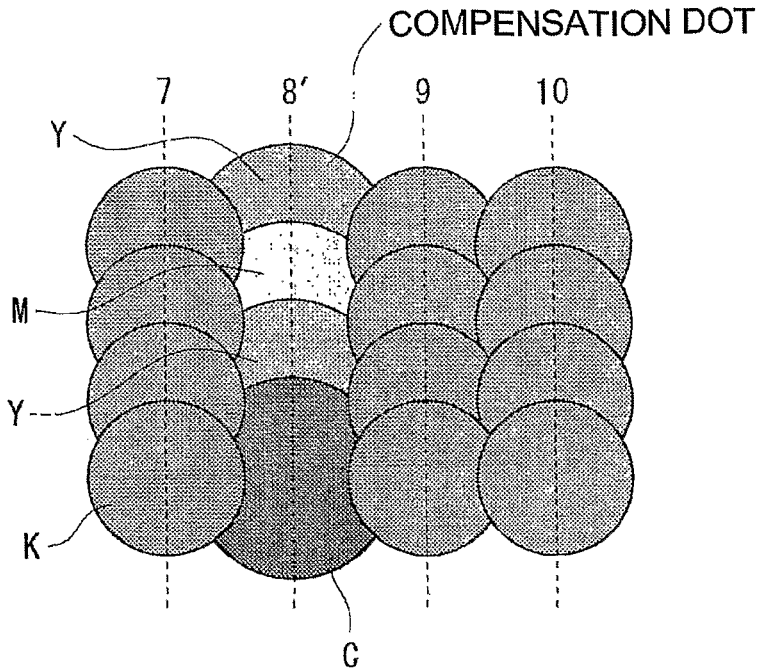
FIG. 11 is a conceptual diagram illustrating an example of a dot pattern formed by the use of the image forming method according to the present invention.

Accordingly, as shown in FIG. 11, by correcting the data so as to alternately form compensation dots having different colors, it is possible to prevent the generation of the "color stripe" due to the continuous dots having the same color. In addition, since that portion changes to black or dark colors depending on the combination of colors (mixture of colors), it is possible to make the "white stripe" more satisfactorily invisible to the naked eye when surrounding dots have a dark color such as black or cyan.

Next, FIGS. 12 to 17 show a second embodiment of the image forming apparatus 100 according to the present invention.

Figure 12:
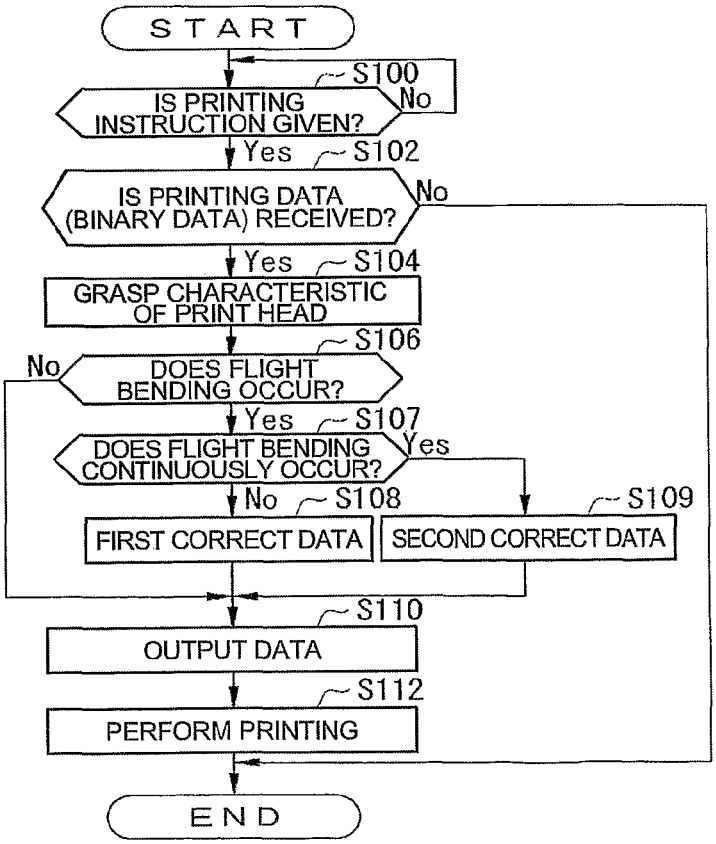
FIG. 12 is a flowchart illustrating another example of the processing flow of the image forming method according to the present invention.

That is, as shown in the flowchart of FIG. 12, the present embodiment is similar to the first embodiment in the steps S100 to S106, but when it is determined in the step S106 that the flight bending phenomenon occurs, it is checked in the step S107 whether the flight bending phenomenon continuously occurs before performing the step S108. Depending on the check result, the data are corrected by selective using the compensation process and another compensation process.

Here, since the first data correcting of the step S108 has been described above, its description is omitted. A specific example of a second data correcting when it is determined in the step S109 that the flight bending continuously occurs (Yes) will be described.

Figure 13:
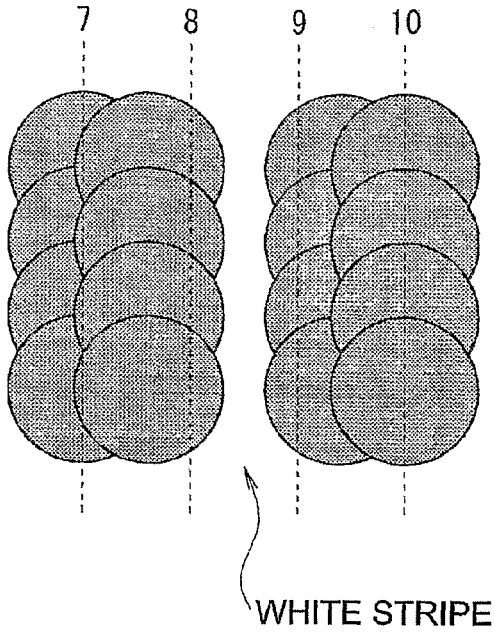
FIG. 13 is a conceptual diagram illustrating an example of a dot pattern formed when the flight bending phenomenon continuously occurs.

FIG. 13 shows an example of a dot pattern formed when the normal nozzle N9 as well as the nozzle N8 generates the flight bending phenomenon toward the nozzle N10 in the black nozzle module 50.

Figure 14A:
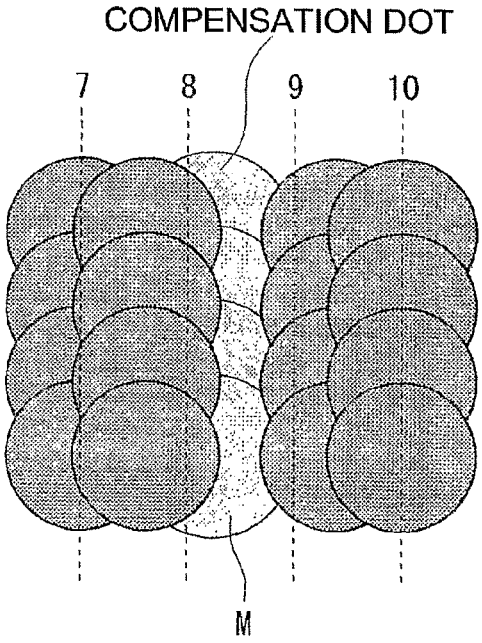
FIG. 14 is a conceptual diagram illustrating an example of a dot pattern formed by the use of the image forming method according to the present invention.
Figure 14B:
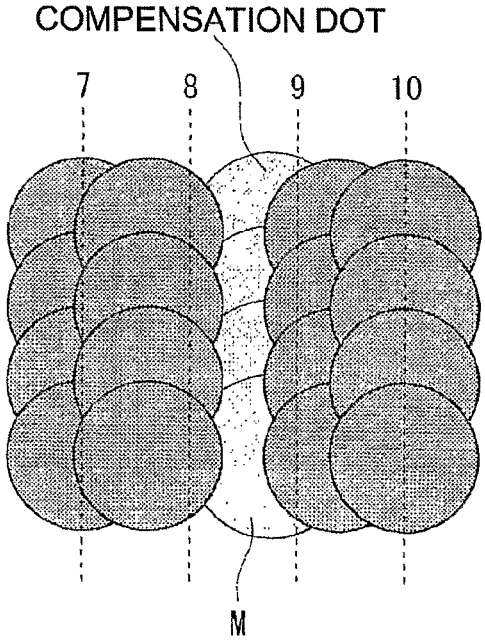
Figure 15:
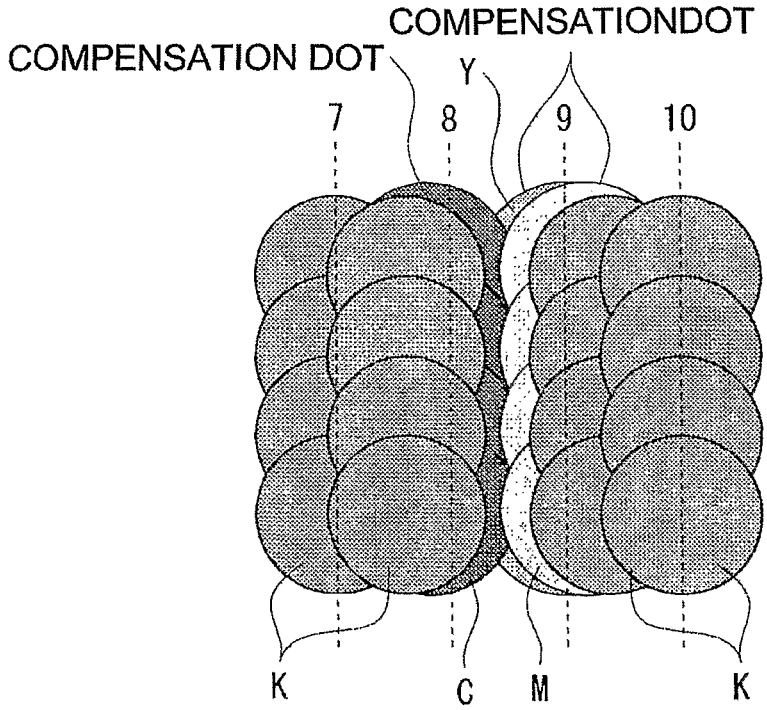
FIG. 15 is a conceptual diagram illustrating an example of a dot pattern formed by the use of the image forming method according to the present invention.

When the flight bending phenomenon continuously occurs and the flight bending is relatively small, the original binary data can be corrected so as to form large compensation dots by the use of one or both of other nozzles corresponding to the nozzle N8 and the nozzle N9 as shown in FIG. 14 or 15. As a result, the relatively large "white stripe" occurring in the meantime can be surely covered with the compensation dots, thereby removing or making the "white stripe" almost invisible to the naked eye.

Figure 16:
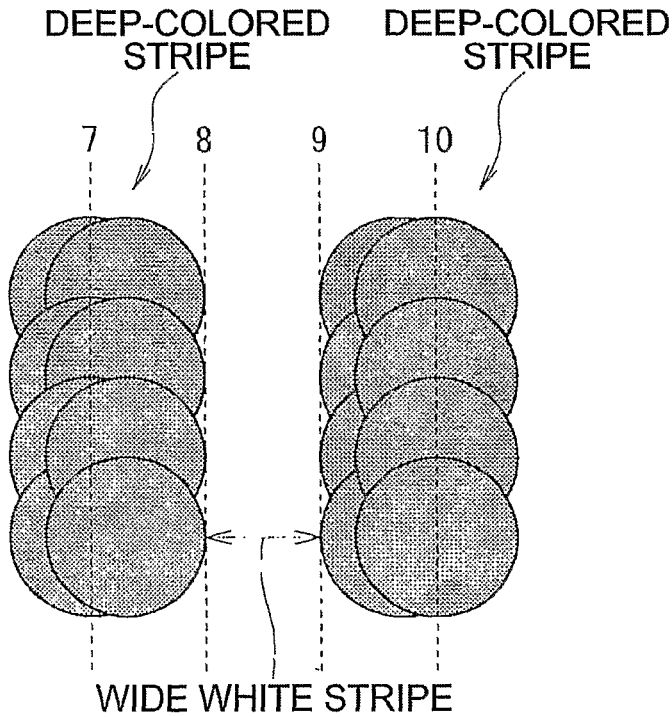
FIG. 16 is a conceptual diagram illustrating an example of a dot pattern formed when the flight bending phenomenon occurs severely and continuously.

As shown in FIG. 16, when the nozzle N8 and the nozzle N9 all generate the large flight bending and the dots therefrom are overlapped on the adjacent normal dots, the data can be corrected so as to stop the formation of dots by the use of the nozzle N8 and the nozzle N9 generating the flight bending phenomenon (to thin out the dots) and to form only the compensation dots, similar to the first embodiment. As a result, similar to the first embodiment, it is possible to avoid the generation of the "deep-colored stripe" formed on both sides of the "white stripe" as well as the "white stripe" at the same time.

Figure 17:
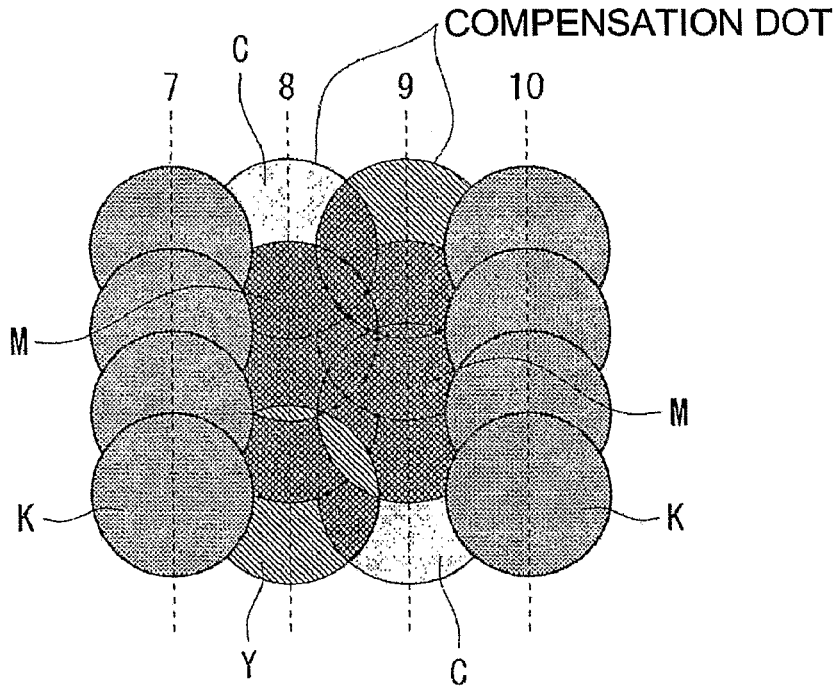
FIG. 17 is a conceptual diagram illustrating an example of a dot pattern formed by the use of the image forming method according to the present invention.

In this way, when two lines of dots are thinned out and only the compensation dots are formed, that portion is widened in comparison with the case that one line of dots is thinned out. Accordingly, when the compensation dots having the same color are formed, the color may form a stripe. As a result, as shown in FIG. 17, by alternately forming compensation dots having various colors so that the same color is not continuous, it is possible to avoid the generation of the "color stripe". In addition, by combining a plurality of colors, the color of the compensation dots can approach the color of the normal dots.

In the present invention, since the dots having the different colors are formed in the white stripe portion generated due to the flight bending phenomenon, the visibility of the white stripe deteriorates, thereby removing or making the white stripe almost invisible to the naked eye.

When the ink is jetted from the abnormal nozzle generating the flight bending phenomenon and the normal nozzle adjacent to the abnormal nozzle, the data are corrected so as to stop the jetting of the ink from the abnormal nozzle, thereby not overlapping the dots on the dots at the normal position in the vicinity of the abnormal position. Accordingly, it is possible to remove the deep-colored stripe generated in the overlapping portion.

As a result, it is possible to obtain a printed matter with high quality even from the print head (printer) generating the flight bending phenomenon, in which the white stripe or the deep-colored stripe is almost invisible.

In the present invention, since the original binary data are corrected based on the characteristic of the print head without changing the conventional printing means 40 itself, it is possible to use the conventional specific inkjet printer itself as the printing means 40. In addition, by separating the printing means 40, the print instructing terminal such as PC can generate the corrected binary data.

Figure 18A:
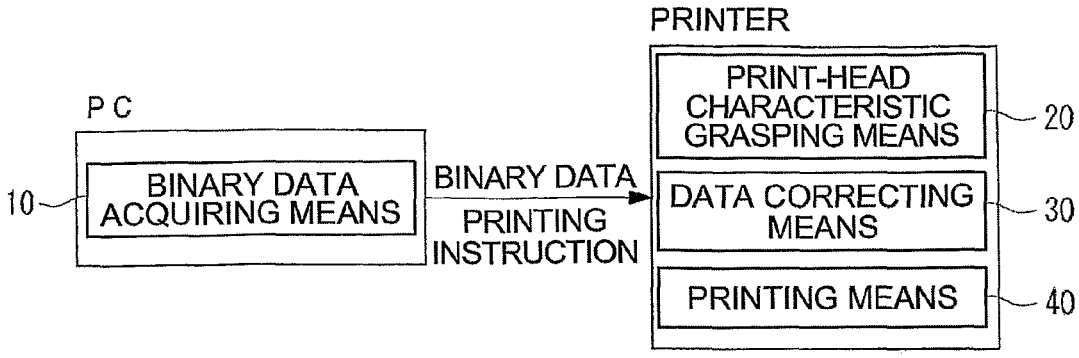
FIG. 18 is a conceptual diagram illustrating an example that the image forming apparatus according to the present invention is composed of a personal computer and a printer and that the functions of the image forming apparatus are distributed thereto.
Figure 18B:
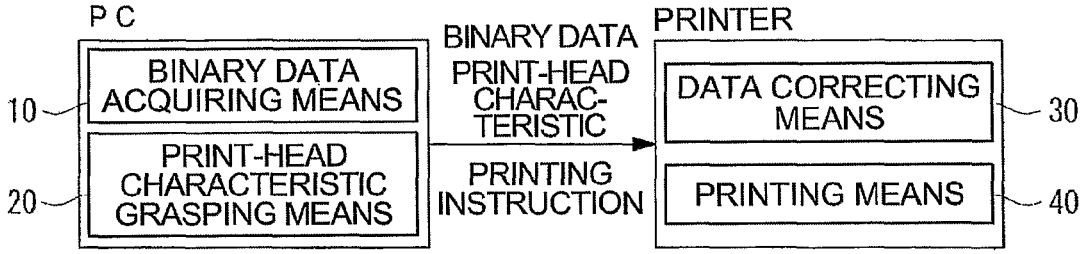
Figure 18C:
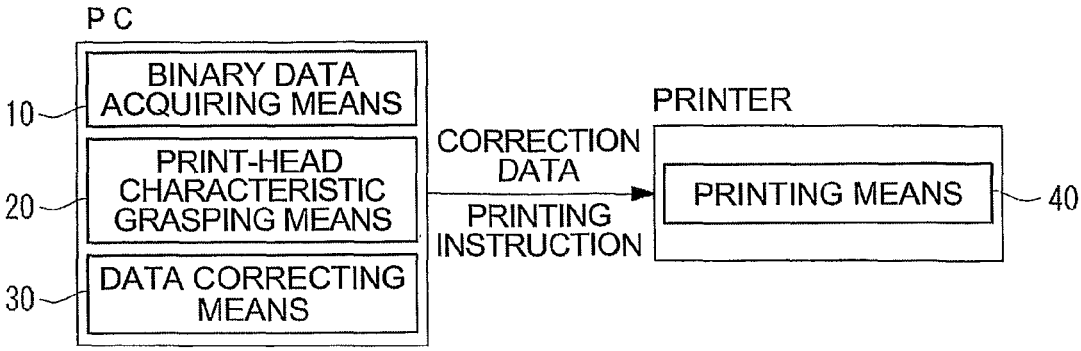

As shown in FIGS. 18(A) to 18(C), the image forming apparatus 100 according to the present invention may be composed of a personal computer (PC) and a printer and the functions of the elements may be divided and incorporated into the PC and the printer. For example, only the binary data acquiring means 10 or the binary data acquiring means 10 and the print-head characteristic grasping means 20 may be embodied in the PC, and the data correcting means 30 and the printing means 40 may be embodied in the printer.

When the construction that the printing means 40 is excluded from the image forming apparatus 100, that is, the construction including the binary data acquiring means 10, the print-head characteristic grasping means 20, and the data correcting means 30, is embodied in the personal computer, it is possible to provide a data generating apparatus for supplying the correction data to the conventional printer. By using hardware resources such as the personal computer, it is possible to embody the binary data acquiring means 10, the print-head characteristic grasping means 20, and the data correcting means 30 in software (data generating program), respectively.

To the case that the jetting direction of ink is vertical (normal) but the forming position of the nozzle is deviated from the normal position so as for the dots to cause the same result as the flight bending phenomenon, as well as the case that the flight bending phenomenon occurs, the present invention can be applied.

The image forming apparatus 100 according to the present invention can be applied to a multi-pass type inkjet printer (serial printer) as well as a line-head type inkjet printer. In case of the line-head type inkjet printer, it is possible to obtain a printed matter with high quality, in which the white stripe or the deep-colored stripe is almost invisible, by means of a single scan (single pass) even when the flight bending phenomenon occurs. In case of the multi-pass type inkjet printer (serial printer), the number of times for reciprocation can be reduced, thereby enabling the printing at a speed higher than that of the conventional case.

FIG. 19 shows the respective printing methods of the line-head type inkjet printer and the multi-pass type inkjet printer (serial printer).

Figure 19A:
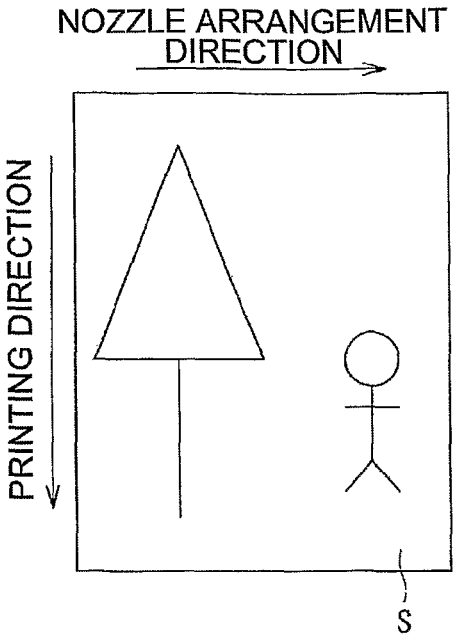
FIG. 19 is an explanatory diagram illustrating a difference in printing technique between a multi-pass type inkjet printer (serial printer) and a line-head type inkjet printer.
Figure 19B:
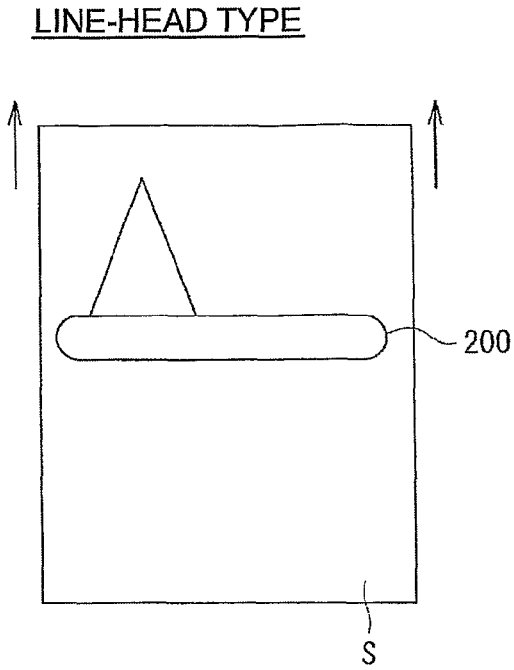
Figure 19C:
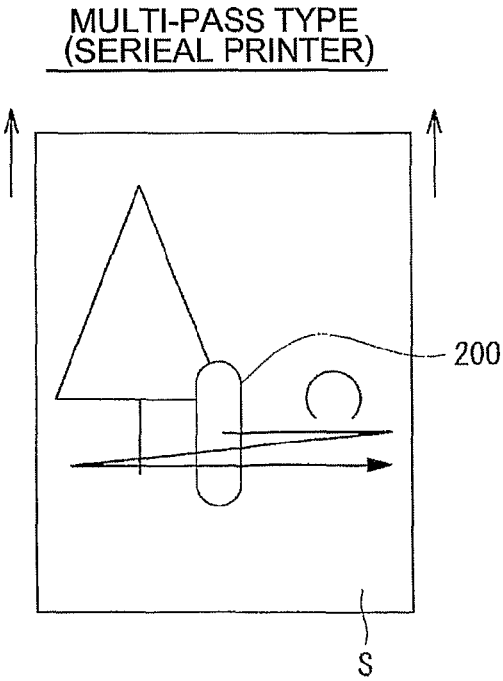

As shown in FIG. 19(A), it is supposed that the width direction of a rectangular print sheet P is the arrangement direction of the nozzles with respect to image data (arrangement direction of a head) and the length direction thereof is the printing direction of the image data (sheet transfer direction). Then, in the line-head type inkjet printer, as shown in FIG. 19(B), the print head 200 has a length corresponding to the width of the print sheet P and completes the printing with a so-called single scan (single pass) by fixing the print head 200 and moving the print sheet P in the printing direction with respect to the print head 200. The printing may be performed while fixing the print sheet P and moving the print head 200 in the sheet transfer direction like a flat bed type scanner or while moving both in the opposite directions. On the contrary, in the multi-pass type inkjet printer (serial printer), as shown in FIG. 19(C), the print head 200 having a length much smaller than the width of the printing sheet is located in a direction perpendicular to the nozzle arrangement direction and the printing is performed by moving the printing sheet P by a predetermined pitch in the sheet transfer direction while reciprocating the print head in the nozzle arrangement direction several times. Therefore, the multi-pass type inkjet printer (serial printer) has a disadvantage that the printing time is longer than that of the line-head type inkjet printer. However, since the print head 200 can be repeatedly located at a position, the multi-pass type inkjet printer (serial printer) can accomplish the reduction of the white stripe among the flight bending phenomenon to some extent.

Although the inkjet printer performing the printing by jetting an ink in dot shapes has been exemplified in the present embodiment, the present invention can be applied to other printers, having a print head in which printing nozzles are arranged in a line shape, such as a thermal head printer which is also referred to as a thermal transfer printer or an electro-thermal printer.

Figure 3:
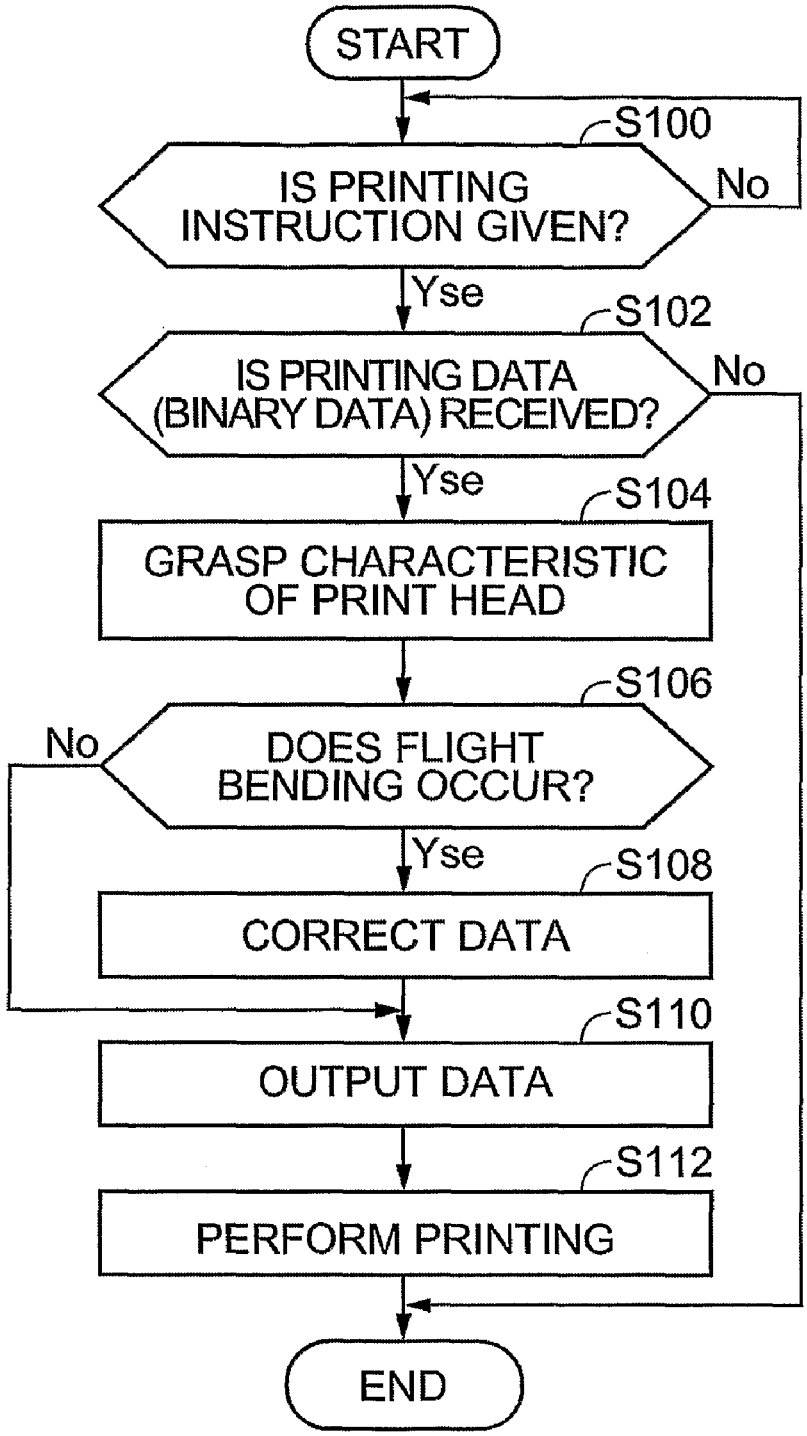
FIG. 3 is a flowchart illustrating an example of a processing flow of an image forming method according to the present invention.
Figure 20:
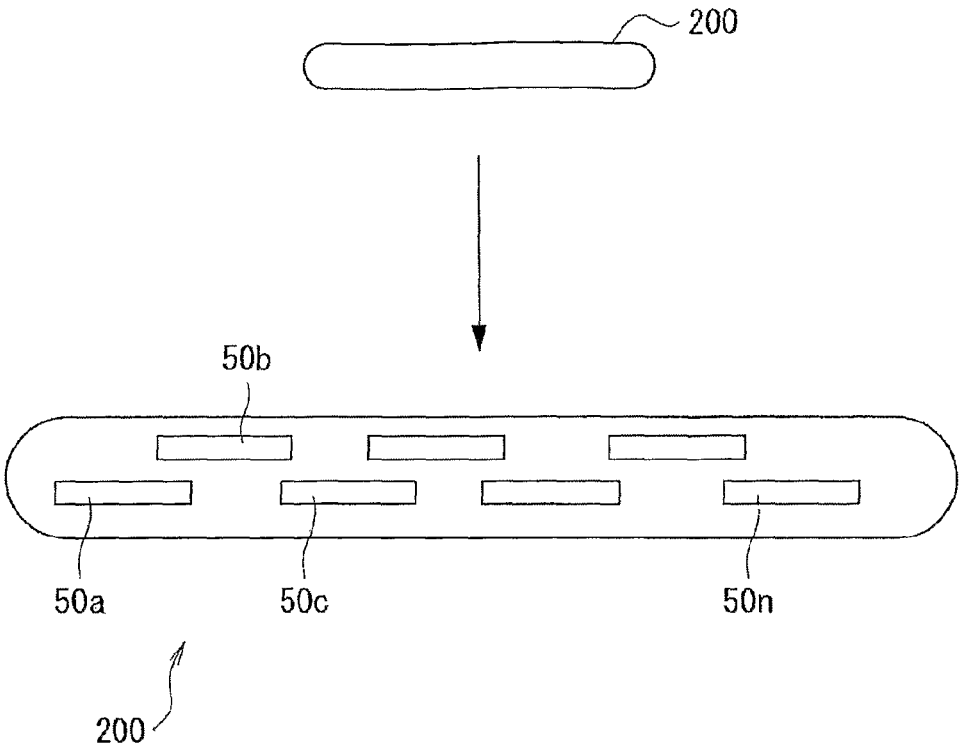
FIG. 20 is a conceptual diagram illustrating another example of the print head having a different structure.

In FIG. 3, the respective nozzle modules 50, 52, 54, and 56 provided in the print head 200 for each color have a shape that the nozzles N are continuously arranged in a straight line shape in the length direction of the print head 200. However, as shown in FIG. 20, the nozzle modules 50, 52, 54, and 56 may be composed of a plurality of short nozzle units 50*a*, 50*b*, . . . , and 50*n* and the nozzle units may be arranged at the front and rear sides in the moving direction of the print head 200. Specifically, when each nozzle module 50, 52, 54, or 56 is composed of a plurality of short nozzle units 50*a*, 50*b*, . . . , and 50*n*, it is possible to substantially shorten the distance between dots without decreasing the actual distance between dots (pitch) of the respective nozzle units 50*a*, 50*b*, . . . , 50*n*. Accordingly, it is possible to easily cope with images with a high resolution.

Figure 21:
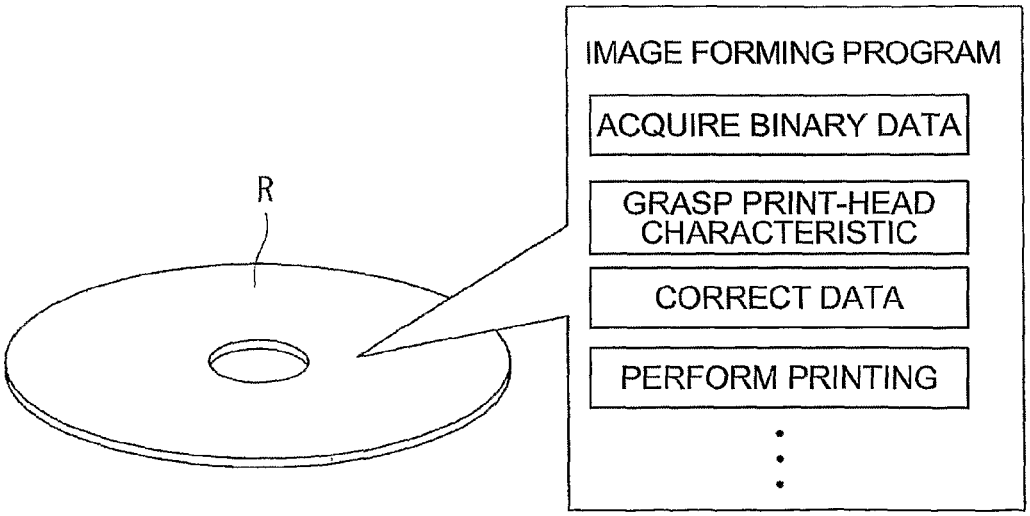
FIG. 21 is a conceptual diagram illustrating an example of a computer-readable recording medium in which an image processing program according to the present invention is recorded.

The respective means and steps for embodying the image forming apparatus 100 or the image forming method according to the present invention described above can be embodied in software by the use of a general-purpose computer system such as a personal computer. The computer program can be incorporated into a product in a state where the program is stored in advance in a semiconductor ROM or can be delivered through a network such as Internet. In addition, the computer program can be easily provided to users through a computer-readable recording medium R such as CD-ROM, DVD-ROM, and FD as shown in FIG. 21.

The invention claimed is:

1. An image forming apparatus that forms a predetermined image with binary data on a print medium by jetting an ink from a plurality of nozzle modules, which are arranged in a print head by colors, while moving one or both of the print medium and the print head, the image forming apparatus comprising:

a binary data acquiring means for acquiring the binary data;

a print-head characteristic grasping means for grasping a characteristic of the print head;

a data correcting means for correcting the binary data based on the characteristic of the print head grasped by the print-head characteristic grasping means; and a printing means for performing the printing based on the corrected data output from the data correcting means, wherein when a dot is formed by the use of a normal nozzle and an abnormal nozzle detected by the print-head characteristic grasping means, the data correcting means corrects the binary data so as not to form a dot by the use of the abnormal nozzle and corrects the binary data so as to form a compensation dot, which has a color different from a color used by the abnormal nozzle, in the vicinity of a dot forming position by the abnormal nozzle;

wherein the data correcting means corrects the binary data so as to form, as the compensation dot, a dot having a color of which a concentration value or a brightness value approaches the concentration value or the brightness value of the dot formed by the use of the abnormal nozzle by a predetermined value or less;

wherein the data correcting means corrects the binary data such that when the print head can form dots having four or more colors including black, magenta, cyan, and yellow and the color of the dot formed by the use of the abnormal nozzle is black, a dot having a combination of magenta, cyan, and yellow, a combination of magenta and cyan a combination of magenta and yellow, a combination of cyan and yellow, or any one of magenta and cyan is formed as the compensation dot; and wherein the data correcting means corrects the binary data such that when the dot formed by the abnormal nozzle is continuous in the printing direction, two or more of a dot having a combination of magenta, cyan, and yellow, a dot having a combination of magenta and cyan, and a dot having one of magenta and cyan are alternately formed as the compensation dot.

2. The image forming apparatus according to claim 1, further comprising a multi-dot forming means for controlling the print head so as to form the compensation dot greater than the dot formed by the use of a nozzle module including the abnormal nozzle.

3. The image forming apparatus according to claim 1, wherein the data correcting means corrects the binary data such that when the print head can form a plurality of colors of dots and the color of the dot formed by the use of the abnormal nozzle is black, the compensation dot is formed by combining the plurality of colors.

4. The image forming apparatus according to claim 1, wherein the data correcting means corrects the binary data such that when the print head can form dots having four or more colors including black, magenta, cyan, and yellow and the color of the dot formed by the use of the abnormal nozzle is magenta, a dot having a black color, a cyan color, or a combination of cyan and yellow is formed as the compensation dot.

5. The image forming apparatus according to claim 1, wherein the data correcting means corrects the binary data such that when the print head can form dots having four or more colors including black, magenta, cyan, and yellow and the color of the dot formed by the use of the abnormal nozzle is cyan, dots having a black color, a magenta color, or a combination of magenta and yellow is formed as the compensation dot.

6. The image forming apparatus according to claim 1, wherein the print-head characteristic grasping means includes a print-head characteristic detecting unit for detecting the characteristic of the print head from an image formed by the use of the print head, and wherein the print-head characteristic grasping means detects the abnormal nozzle every nozzle module of the print head based on the characteristic of the print head detected by the print-head characteristic detecting unit.

* * * * *